US006811241B2

(12) United States Patent
Niishida et al.

(10) Patent No.: US 6,811,241 B2
(45) Date of Patent: Nov. 2, 2004

(54) LIQUID JETTING HEAD, LIQUID JETTING APPARATUS INCORPORATING THE SAME, METHOD AND APPARATUS FOR MEASURING NATURAL VIBRATION PERIOD OF THE SAME

(75) Inventors: Keisuke Niishida, Nagano (JP); Satoru Hosono, Nagano (JP); Tomoaki Takahashi, Nagano (JP); Ryoichi Tanaka, Nagano (JP); Hirofumi Teramae, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 116 days.

(21) Appl. No.: 10/342,334

(22) Filed: Jan. 15, 2003

(65) Prior Publication Data

US 2003/0146742 A1 Aug. 7, 2003

(30) Foreign Application Priority Data

| | | |
|---|---|---|
| Jan. 15, 2002 | (JP) | P2002-005511 |
| Feb. 4, 2002 | (JP) | P2002-026334 |
| Feb. 25, 2002 | (JP) | P2002-047747 |
| Mar. 14, 2002 | (JP) | P2002-070656 |
| Dec. 11, 2002 | (JP) | P2002-359286 |

(51) Int. Cl.[7] ..... B41J 29/393; B41J 29/38

(52) U.S. Cl. ..... 347/19; 347/14; 347/12; 347/6; 347/5

(58) Field of Search ..... 347/19, 5, 6, 12, 347/14, 11, 10, 9, 8, 23

(56) References Cited

U.S. PATENT DOCUMENTS 5,369,420 A * 11/1994 Bartky ..... 347/19
6,231,150 B1 * 5/2001 Ito ..... 347/11

FOREIGN PATENT DOCUMENTS

JP 2002-154212 5/2002

* cited by examiner

*Primary Examiner*—Stephen Meier
*Assistant Examiner*—Charles Stewart, Jr.
(74) *Attorney, Agent, or Firm*—Sughrue Mion, PLLC

(57) ABSTRACT

A first evaluation signal includes a first excitation element adapted to excite pressure fluctuation in liquid contained in the pressure chamber and a first ejection element which follows the excitation element after a first time period to eject a first liquid droplet from the nozzle. A second evaluation signal includes a second excitation element adapted to excite pressure fluctuation in liquid contained in the pressure chamber and a second ejection element which follows the excitation element after a second time period to eject a second liquid droplet from the nozzle which is longer than the first time period. The first evaluation signal is supplied to the pressure generating element to measure a first ejected amount of the first liquid droplet. The second evaluation signal is supplied to the pressure generating element to measure a second ejected amount of the second liquid droplet. An ejected amount ratio of the first ejected amount and the second ejected amount is calculated. A natural vibration period of a liquid jetting head based on the ejected amount ratio.

43 Claims, 22 Drawing Sheets

LIQUID JETTING HEAD, LIQUID JETTING APPARATUS INCORPORATING THE SAME, METHOD AND APPARATUS FOR MEASURING NATURAL VIBRATION PERIOD OF THE SAME

BACKGROUND OF THE INVENTION

The present invention relates to a liquid jetting head capable of ejecting various kinds of liquid in the form of droplets for use in an ink jet recording apparatus, a display manufacturing apparatus, an electrode forming apparatus, a biochip manufacturing apparatus, etc., and particularly relates to a method and an apparatus for measuring the natural vibration period concerning liquid stored in a pressure chamber, and a liquid jetting apparatus in which the waveform of a drive signal is established on the basis of the determined natural vibration period.

As a liquid jetting apparatus having a liquid jetting head capable of ejecting liquid in the form of a liquid droplet, for example, there has been proposed an image recording apparatus in which ink droplets are ejected to record an image or the like on recording paper, an electrode forming apparatus in which an electrode material in a liquid form is ejected onto a substrate to thereby form electrodes, a biochip manufacturing apparatus in which biological samples are ejected to manufacture biochips, or a micropipette for ejecting a predetermined amount of a sample into a vessel.

To eject a liquid droplet, the liquid jetting head uses a change of pressure in the liquid stored in the pressure chamber. In the liquid jetting head, pressure vibration is excited in the liquid in the pressure chamber with the change of pressure as if the inside of the pressure chamber were an acoustic tube. The period of the pressure vibration is also called a natural vibration period because it is fixed for each kind of liquid jetting head. Then, the natural vibration period can be varied among liquid jetting heads belonging to one and the same kind. This is because there occurs a variation in dimensions or setting accuracy of parts constituting the liquid jetting heads. In accordance with the variation of the natural vibration period, there occurs a variation in droplet ejecting properties such as droplet ejecting amount or flight velocity. This is because the change of liquid pressure differs in accordance with the natural vibration period when the heads are driven by one and the same drive signal, so that there occurs a difference in position or moving speed of a meniscus (free face of liquid exposed in the nozzle orifice) at the time of liquid droplet ejection.

Under such circumstances, there has been proposed an apparatus for measuring the natural vibration period of a liquid jetting head and controlling waveform elements forming a drive signal on the basis of the result of the measurement. Various methods for measuring the natural vibration period have been proposed. However, the productivity will be lowered if it takes long time to measure the natural vibration period. Taking this point into consideration, a method has been proposed in which three kinds of evaluation pulses set to have different time intervals between an excitation signal and an ejection signal are used to classify liquid jetting heads into a plurality of Tc ranks based on liquid ejection amounts corresponding to the respective evaluation pulses (for example, disclosed in Japanese Patent Publication No. 2002-154212A). In this related-art method, it will be sufficient if the ejected liquid amount is measured three times for one liquid jetting head. Accordingly, the work of measurement can be carried out efficiently. Thus, this method is suitable to mass production.

However, in order to further improve the productivity, it is necessary that the measurement of the natural vibration period is made more efficient. In addition, in order to control the amount or the flight velocity of an ejected droplet with higher accuracy, it is desired that the natural vibration period of a liquid jetting head itself is measured.

SUMMARY OF THE INVENTION

It is therefore an object of the invention to make the measurement of the natural vibration period more efficient while improving the measuring accuracy of the natural vibration period. It is also one object of the invention to control the amount or the flight velocity of an ejected droplet with higher accuracy.

In order to achieve the above objects, according to the invention, there is provided a method of measuring a natural vibration period of a liquid jetting head provided with a nozzle orifice, a pressure chamber communicated with the nozzle orifice, a liquid supply port which supplies liquid into the pressure chamber, and a pressure generation element which causes pressure fluctuation in the liquid contained in the pressure chamber, the method comprising steps of:

providing a first evaluation signal including a first excitation element adapted to excite pressure fluctuation in liquid contained in the pressure chamber and a first ejection element which follows the excitation element after a first time period to eject a first liquid droplet from the nozzle;

providing a second evaluation signal including a second excitation element adapted to excite pressure fluctuation in liquid contained in the pressure chamber and a second ejection element which follows the excitation element after a second time period to eject a second liquid droplet from the nozzle, which is longer than the first time period;

supplying the first evaluation signal to the pressure generating element to measure a first ejected amount of the first liquid droplet;

supplying the second evaluation signal to the pressure generating element to measure a second ejected amount of the second liquid droplet;

calculating an ejected amount ratio of the first ejected amount and the second ejected amount; and determining the natural vibration period of the liquid jetting head based on the ejected amount ratio.

According to the invention, there is also provided an apparatus for measuring a natural vibration period of a liquid jetting head provided with a nozzle orifice, a pressure chamber communicated with the nozzle orifice, a liquid supply port which supplies liquid into the pressure chamber, and a pressure generation element which causes pressure fluctuation in the liquid contained in the pressure chamber, the apparatus comprising:

a first evaluation signal generator, which generates a first evaluation signal including a first excitation element adapted to excite pressure fluctuation in liquid contained in the pressure chamber and a first ejection element which follows the excitation element after a first time period to eject a first liquid droplet from the nozzle;

a second evaluation signal generator, which generates a second evaluation signal including a second excitation element adapted to excite pressure fluctuation in liquid contained in the pressure chamber and a second ejection element which follows the excitation element after a second time period to eject a second liquid droplet from the nozzle;

a first evaluation signal supplier, which supplies the first evaluation signal to the pressure generating element to measure a first ejected amount of the first liquid droplet;

a second evaluation signal supplier, which supplies the second evaluation signal to the pressure generating element to measure a second ejected amount of the second liquid droplet;

a calculator, which calculates an ejected amount ratio of the first ejected amount and the second ejected amount; and a natural vibration period determinant, which determines the natural vibration period of the liquid jetting head based on the ejected amount ratio.

In the above configuration, since it will be sufficient if the amount of liquid is measured twice for one liquid jetting head, it is simple and easy to support the automation of a manufacturing line. It is therefore possible to manufacture liquid jetting heads without reducing the productivity. Thus, the invention is suitable to mass production. Further, since there is a high correlation between the natural vibration period and the ejected amount ratio the natural vibration period of a liquid jetting head subjected to the measurement can be determined with high accuracy.

Preferably, the method further comprises steps of:

providing a plurality of measurement signals, each including an excitation element adapted to excite pressure fluctuation in liquid contained in the pressure chamber and an ejection element which follows the excitation element after a predetermined time period different from another measurement signals to eject a liquid droplet from the nozzle;

providing a first liquid jetting head having a maximum natural vibration period that can be established in a manufacturing process;

providing a second liquid jetting head having a minimum natural vibration period that can be established in the manufacturing process;

supplying the measurement signals to the first liquid jetting head to obtain a first ejected amount fluctuation curve which indicates relationship between input natural vibration periods and output ejected liquid amounts in the first liquid jetting head;

supplying the measurement signals to the second liquid jetting head to obtain a second ejected amount fluctuation curve which indicates relationship between input natural vibration periods and output ejected liquid amounts in the second liquid jetting head;

determining a first time range in which an output ejected liquid amount increases in accordance with increase of an input natural vibration period in both of the first ejected amount fluctuation curve and the second ejected amount fluctuation curve;

determining a second time range in which an output ejected liquid amount decreases in accordance with increase of an input natural vibration period in both of the first ejected amount fluctuation curve and the second ejected amount fluctuation curve;

determining the first time period such that the first ejection element is supplied at a timing in the first time range; and determining the second time period such that the second ejection element is supplied at a timing in the second time range.

In such a configuration, when the natural vibration period varies, one of the first and second ejected amounts increases while the other decreases. Accordingly, the variation of the ejected amount ratio relative to the unit variation of the natural vibration period can be secured to be larger than any other setting. As a result, the natural vibration period can be determined with high accuracy.

Here, it is preferable that: the first time range continues from one peak point in the first ejected amount fluctuation curve to one bottom point in the second ejected amount fluctuation curve which is adjacent to the one peak point; and the second time range continues from one bottom point in the first ejected amount fluctuation curve to one peak point in the second ejected amount fluctuation curve which is adjacent to the one bottom point.

Further, it is preferable that the method further comprises steps of:

providing a third liquid jetting head having a standard natural vibration period which matches with a designed value;

supplying the measurement signals to the third liquid jetting head to obtain a third ejected amount fluctuation curve which indicates relationship between input natural vibration periods and output ejected liquid amounts in the third liquid jetting head; and determining the first time period and the second time period such that the first ejection element and the second ejection element are supplied at timings at which the third ejected amount fluctuation curve has a maximum gradient value.

In such a configuration, the variation width of the ejected amount ratio relative to the variation width of the natural vibration period can be expanded to be as large as possible, so that the natural vibration period can be determined on the basis of the ejected amount ratio with high accuracy.

Further, it is preferable that the first time range and the second time range are determined within adjacent fluctuation cycles of the first ejected amount fluctuation curve and the second ejected amount fluctuation curve.

Preferably, the method further comprises steps of:

providing a plurality of measurement signals, each including an excitation element adapted to excite pressure fluctuation in liquid contained in the pressure chamber and an ejection element which follows the excitation element after a predetermined time period different from another measurement signals to eject a liquid droplet from the nozzle;

providing a first liquid jetting head having a maximum natural vibration period that can be established in a manufacturing process;

providing a second liquid jetting head having a minimum natural vibration period that can be established in the manufacturing process;

supplying the measurement signals to the first liquid jetting head to obtain a first ejected amount fluctuation curve which indicates relationship between input natural vibration periods and output ejected liquid amounts in the first liquid jetting head;

supplying the measurement signals to the second liquid jetting head to obtain a second ejected amount fluctuation curve which indicates relationship between input natural vibration periods and output ejected liquid amounts in the second liquid jetting head;

determining the first time period and the second time period such that the first ejection element and the second ejection element are supplied at timings within a time range from one peak point in the first ejected amount fluctuation curve to one peak point in the second ejected amount fluctuation curve which is adjacent to the one peak point.

In such a configuration, the ejected amount fluctuation curve of a liquid jetting head subjected to the measurement exists between the first ejected amount fluctuation curve and the second period ejected amount fluctuation curve.

Accordingly, the natural vibration period can be determined with extremely high accuracy on the basis of the ejected amount ratio.

Here, it is preferable that the method further comprises steps of:

providing a third liquid jetting head having a standard natural vibration period which matches with a designed value;

supplying the measurement signals to the third liquid jetting head to obtain a third ejected amount fluctuation curve which indicates relationship between input natural vibration periods and output ejected liquid amounts in the third liquid jetting head; and determining the first time period and the second time period such that an average value thereof is placed on one bottom point in the third ejected amount fluctuation curve.

Still preferably, a difference between the first time period and the second time period is a half of the standard natural vibration period.

Preferably, each potential difference of the first excitation element and the second excitation element is not less than 90% of each potential difference of the first ejection element and the second ejection element.

Still preferably, each potential difference of the first excitation element and the second excitation element is not less than 95% of each potential difference of the first ejection element and the second ejection element.

Preferably, the method further comprises steps of:

judging whether the ejected amount ratio is within a predetermined value range;

modifying at least one of the first evaluation signal and the second evaluation signal when the ejected amount ratio is not within the predetermined value range; and measuring at least one of the first ejected amount and the second ejected amount with at least one modified evaluation signal before the step of determining the natural vibration period.

In such a configuration, the natural vibration period of a liquid jetting head can be measured with high accuracy even in a liquid jetting head whose natural vibration period is largely deviated from the designed value.

Here, it is preferable that both of the first evaluation signal and the second evaluation signal when the ejected amount ratio is not within the predetermined value range.

Further, it is preferable that the method further comprises step of updating the ejected amount ratio based on the first ejected amount and the second ejected amount measured with the at least one modified evaluation signal.

Specifically, the first time period is updated to a further shorter third time period when the determined natural vibration period is less than a predetermined value range, and the second time period is updated to a further longer fourth time period when the determined natural vibration period is greater than the predetermined value range.

Preferably, the natural vibration period is determined based on a correlation between the ejected amount ratio and the natural vibration period.

Here, it is preferable that the correlation is provided as a linear expression in which the ejected amount ratio serves as a variable.

Specifically, it is preferable that: a variable range of the ejected amount ratio is divided into a plurality of ranges; and the linear expression is provided with respect to each of the divided ranges.

Here, it is preferable that the divided ranges includes a first range which is less than a standard ejected amount ratio corresponding to a designed natural vibration period, and a second range which is not less than the standard ejected amount ratio.

Alternatively, it is preferable that the divided ranges includes a first range including a standard ejected amount ratio corresponding to a designed natural vibration period, a second range which is less than the first range, and a third range which is greater than the first range.

In such configurations, the natural vibration period can be determined with high accuracy on the basis of the ejected amount ratio.

Preferably, the first evaluation signal and the second evaluation signal are supplied to the pressure generating element at a frequency which is not greater than 10 kHz.

Still preferably, the first evaluation signal and the second evaluation signal are supplied to the pressure generating element at a frequency which is not greater than 5 kHz.

In such configurations, a liquid droplet can be ejected in a stable condition so that the weight of the liquid droplet can be measured with higher accuracy.

Preferably, the method further comprises steps of: measuring temperature of operation environment of the liquid jetting head; and correcting the natural vibration period based on the temperature.

Incidentally, the correcting step includes both the case where the natural vibration period is corrected through the correction of the ejected liquid amount and the case where the determined natural vibration period is corrected directly.

In such a configuration, the natural vibration period can be determined with high accuracy even if the viscosity of the liquid varies in accordance with the environmental temperature.

Preferably, the method comprises steps of: acquiring dimension information regarding at least one of the liquid supply port, pressure chamber and the nozzle orifice; and correcting the natural vibration period based on the dimension information.

Incidentally, the correcting step includes both the case where the natural vibration period is corrected through the correction of the ejected liquid amount and the case where the determined natural vibration period is corrected directly.

Preferably, the liquid is ink comprising a coloring material.

According to the invention, there is also provided a liquid jetting recording head, comprising:

a nozzle orifice;

a pressure chamber communicated with the nozzle orifice;

a liquid supply port which supplies liquid into the pressure chamber;

a pressure generation element which causes pressure fluctuation in the liquid contained in the pressure chamber; and an indicator, which indicates the natural vibration period determined by the above measuring method.

Preferably, the liquid jetting head further comprises an information storage, which stores the natural vibration period.

Preferably, the indicator is optically readable member.

According to the invention, there is also provided a liquid jetting recording head, comprising:

a nozzle orifice;

a pressure chamber communicated with the nozzle orifice;

a liquid supply port which supplies liquid into the pressure chamber;

a pressure generation element which causes pressure fluctuation in the liquid contained in the pressure chamber; and an indicator, which indicates the ejected amount ratio calculated by the above measuring method.

Preferably, the liquid jetting head further comprises an information storage, which stores the ejected amount ratio.

Preferably, the indicator is optically readable member.

According to the invention, there is also provided A liquid jetting apparatus, comprising:

the liquid jetting head a nozzle orifice, a pressure chamber communicated with the nozzle orifice, a liquid supply port which supplies liquid into the pressure chamber, a pressure generation element which causes pressure fluctuation in the liquid contained in the pressure chamber, and an indicator which indicates ID information regarding the natural vibration period determined by the above measuring method;

a drive signal generator, which generate a drive signal for driving the pressure generating element; and a corrector, which corrects a waveform of the drive signal based on the ID information.

In such a configuration, the pressure generating element is driven by the optimized drive signal so that the ejected amount or flight velocity of an ejected droplet can be controlled with higher accuracy.

Here, it is preferable that the ID information is numeric information indicating the natural vibration period or information regarding the ejected amount ratio.

Further, it is preferable that: the liquid jetting apparatus further comprises an information storage, which stores the ID information; and the corrector corrects the waveform of the drive signal based on the ID information stored in the information storage.

Further, it is preferable that: the drive signal includes a plurality of waveform elements including an ejection element adapted to eject a liquid droplet from the nozzle orifice; and the corrector corrects a control factor in at least one of the waveform elements.

Here, it is preferable that: the control factor is a duration of the at least one corrected waveform element; and the duration includes an invariable reference duration and a first duration which is variable in accordance with the ID information.

Here, it is still preferable that the duration includes a second duration which is variable in accordance with temperature of operation environment of the liquid jetting apparatus.

In such configuration, the duration of the waveform element can be easily established arithmetically. Incidentally, the first and second durations may include positive and negative numbers respectively.

Further, it is preferable that the corrected waveform element is a damping element related to damping operation of pressure fluctuation after liquid ejection.

Here, it is preferable that: the waveform elements includes a damping expansion element which expands the pressure chamber to damp the pressure fluctuation after the liquid ejection, and a damping hold element generated between the ejection element and the damping expansion element and having a constant potential; and the control factor is a duration of the damping hold element.

Alternatively, it is preferable that: the waveform elements includes a damping contraction element which contracts the pressure chamber to damp the pressure fluctuation after the liquid ejection; and the control factor is a duration of the damping contraction element.

Still alternatively, it is preferable that: the waveform elements includes an expansion element which expands the pressure chamber to pull a meniscus of liquid in the nozzle orifice toward the pressure chamber, and an expansion holding element generated between the expansion element and the ejection element and having a constant potential; and the control factor is a duration of the expansion holding element.

In such configurations, the damping element is optimized so that the meniscus can be rapidly restored after droplet ejection. Thus, the droplet ejection property at the time of high-frequency driving can be stabilized. Incidentally, the "meniscus" means a free surface of the liquid exposed in the nozzle orifice.

Further, it is preferable that the corrector corrects a reference potential of the drive signal defined as an initial end potential and a termination end potential at a unit driving cycle.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments of the invention will be described below with reference to the accompanying drawings. Incidentally, an ink jet printer (hereinafter referred to as "printer" simply) which is a kind of liquid jetting apparatus will be adopted in the following description by way of example. This printer is a kind of image recording apparatus, in which liquid ink (a kind of liquid) is ejected from an ink jet recording head (which is a kind of liquid jetting head, referred to as "recording head" hereinafter) in the form of droplets so as to record information on a recording medium such as paper.

Figure 1:
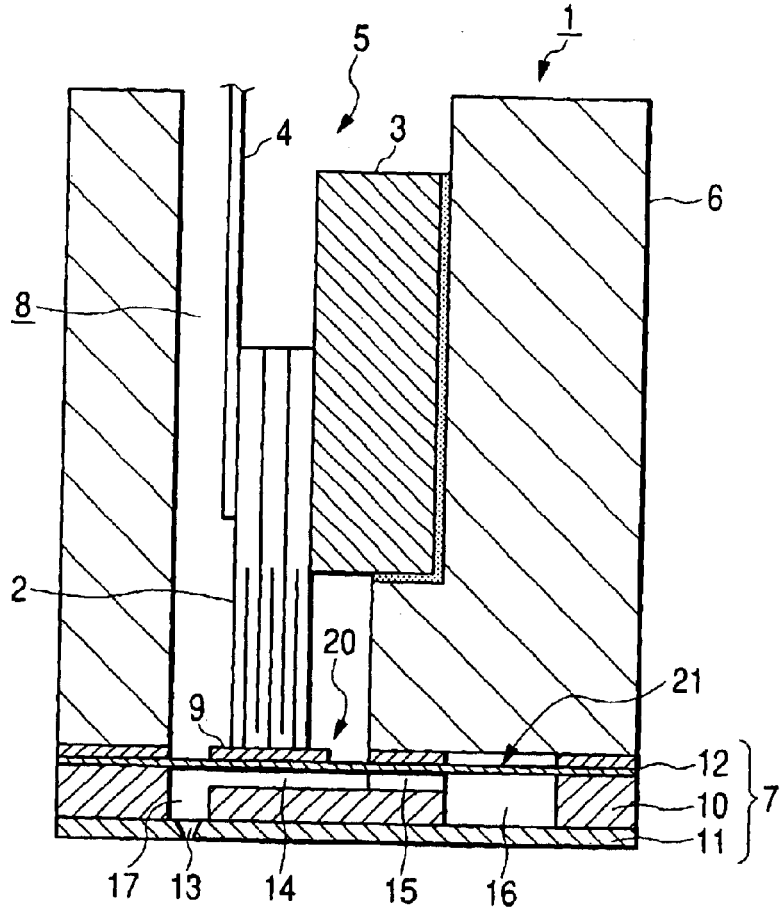
FIG. 1 is a sectional view showing the structure of an ink jet recording head which is one embodiment of a liquid jetting head of the invention.
Figure 2:
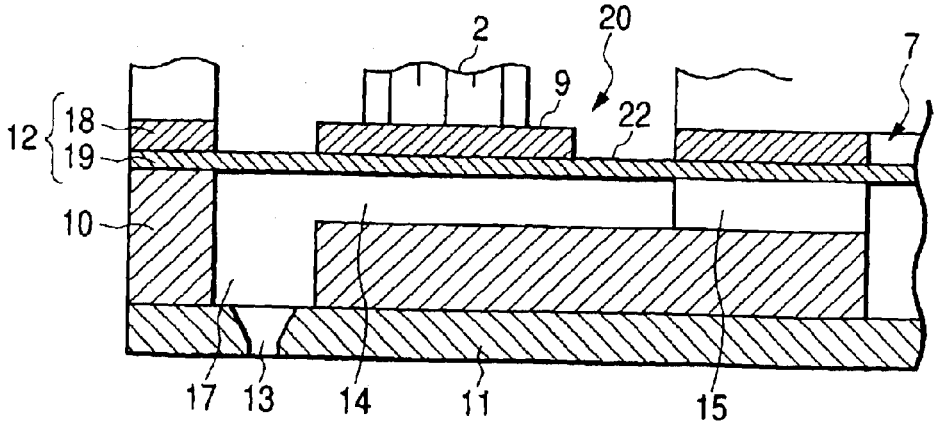
FIG. 2 is an enlarged sectional view showing the structure of a channel unit in the ink jet recording head.

First, description will be made on the structure of a recording head 1 with reference to FIGS. 1 and 2. The illustrated recording head 1 comprises vibrator units 5, a casing 6 which can accommodate the vibrator units 5 therein, and a channel unit 7 which is joined to one end face of the casing 6. In each of the vibrator units 5, a plurality of piezoelectric vibrators 2, a fixation plate 3, a flexible cable 4, and so on, have been unitized.

The casing 6 is a block-shaped member made from synthetic resin so that chambers 8 for storing the vibrator units 5 fixedly are formed inside the casing 6. The chambers 8 are hollow portions penetrating the casing 6 in its height direction. The chambers 8 are provided to be equal in number to the vibrator units 5 to be stored therein. Then, the vibrator units 5 are stored so that the leading end faces of the piezoelectric vibrators 2 face one end openings of the chambers 8, while the fixation plate 3 is bonded to the inner wall face of the casing 6 defining the chambers 8.

Each of the piezoelectric vibrators 2 is a kind of pressure generating element, and also a kind of electromechanical transducing element deformable in accordance with input electric energy. The electric vibrator 2 in this embodiment is pectinated so as to have an extremely narrow width of about 30–100 $\mu$m. In addition, this piezoelectric vibrator 2 is a laminated type piezoelectric vibrator consisting of piezoelectric layers and internal electrodes laminated alternately. The piezoelectric vibrator 2 expands and contracts in a direction perpendicular to the electric field direction and in accordance with the potential difference between the piezoelectric layers and the internal electrodes. Each of such piezoelectric vibrators 2 is attached onto the fixation plate 3 in a cantilevered manner. That is, the proximal portion of each piezoelectric vibrator 2 is bonded onto the fixation plate 3 so that the leading end portion of the piezoelectric vibrator 2 is allowed to protrude to the outside from the edge of the fixation plate 3. Then, the leading end face of each piezoelectric vibrator 2 is bonded to an island portion 9 of the channel unit 7. In addition, the flexible cable 4 is electrically connected to the proximal end portion of each piezoelectric vibrator 2 at a face opposite to the fixation plate 3.

The channel unit 7 is formed in the following manner. That is, as shown in FIG. 2, a nozzle plate 11 is disposed on one face of a channel formation substrate 10 while an elastic plate 12 is disposed on the other face of the channel formation substrate 10 opposite to the nozzle plate 11. Thus, the nozzle plate 11 and the elastic plate 12 are bonded through the channel formation substrate 10.

The nozzle plate 11 is a thin plate made of stainless steel and provided with a plurality of nozzle orifices 13 arranged in a row at a pitch corresponding to the dot forming density. In this embodiment, 96 nozzle orifices 13 are provided at a pitch of 180 dpi to form a nozzle array. Then, a plurality of such nozzle arrays are formed for every ink supply source, for example, for every ink cartridge.

The channel formation substrate 10 is a plate-like member in which a plurality of spaces to be pressure chambers 14 and a plurality of grooves to be ink supply ports 15 are formed at the same pitch as that of the nozzle orifices 13 of the nozzle plate 11, while a space to be a common ink reservoir 16 is formed. The channel formation substrate 10 is, for example, manufactured by etching of a silicon wafer or press working of a metal plate of nickel or the like. In this embodiment, the channel formation substrate 10 is made by etching of a silicon wafer. Each of the pressure chambers 14 is a chamber long in a direction perpendicular to the direction in which the nozzle orifices 13 are arranged (nozzle array direction). Each of the ink supply ports 15 is a groove having a narrow channel width and allowing the common ink reservoir 16 and its corresponding pressure chamber 14 to communicate with each other. In addition, in the pressure chamber 14, a nozzle communication hole 17 for allowing the nozzle orifice 13 and the pressure chamber 14 to communicate with each other is provided in a position farthest from the common ink reservoir 16 so as to penetrate the channel formation substrate 10 in its thickness direction.

The elastic plate 12 has a double structure with an elastic film 19 laminated to the face of a base plate 18. In this embodiment, a resin film made of PPS (polyphenylene sulfide) or PI (polyimide) is laminated as the elastic film 19 to the face of a base plate 18 made of stainless steel. Then, in the elastic plate 12, a diaphragm portion 20 for sealing one-side opening faces of the pressure chambers 14 is provided while a compliance portion 21 for sealing a one-side opening face of the common ink reservoir 16 is also provided. Then, the diaphragm portion 20 is formed by etching the base plate 18 circularly in association with the pressure chambers 14. The diaphragm portion 20 is provided with an elastic portion 22 in which only the elastic film 19 is left, and island portions 9 to which the piezoelectric vibrators 2 will be joined. On the other hand, in the compliance portion 21, the base plate 18 is removed by etching in association with the common ink reservoir 16 so that only the elastic film 19 is left.

In the recording head 1 configured thus, the piezoelectric vibrator 2 expands and contracts in its longitudinal direction in accordance with the vibrator potential so that the volume of the pressure chamber 14 changes. For example, when the vibrator potential is reduced by discharge, the piezoelectric vibrator 2 expands so that the island portion 9 is pushed toward the nozzle plate 11. By this pressure of the island portion 9, the elastic portion 22 of the diaphragm portion 20 is deformed so that the pressure chamber 14 contracts. On the other hand, when the vibrator potential is increased by charging operation, the piezoelectric vibrator 2 contracts so that the island portion 9 is pulled toward the piezoelectric vibrator 2. By this movement of the island portion 9, the pressure chamber 14 expands.

The pressure of ink in the pressure chamber 14 changes in accordance with such a change of volume in the pressure chamber 14. That is, the ink pressure increases with the contraction of the pressure chamber 14, and decreases with the expansion of the pressure chamber 14. Accordingly, when the volume of the pressure chamber 14 is controlled, an ink droplet can be ejected from the nozzle orifice 13. For example, negative pressure is generated in the pressure chamber 14 due to expansion so as to fill the pressure chamber 14 with ink through the ink supply port 15. When the pressure chamber 14 is contracted rapidly after being filled with the ink, the ink in the pressure chamber 14 is pressurized so that an ink droplet can be ejected from the nozzle orifice 13.

Next, description will be made on the manufacturing process of the recording head 1. This manufacturing process comprises an assembling step of assembling the recording head 1 out of the above-described respective constituent parts, a measuring step of measuring a natural vibration period Tc concerning the ink pressure in the pressure chamber 14 in the assembled recording head 1, and an information providing step of providing the recording head 1 with information (ID information) indicating the natural vibration period Tc obtained in the measuring step.

In the assembling step, the recording head 1 is assembled out of the casing 6, the vibrator units 5 and the channel unit 7 manufactured separately from one another. In the assembling step, first, the channel unit 7 is joined to the front end face of the casing 6. This joining is, for example, carried out using an adhesive agent. When the casing 6 and the channel unit 7 have been joined to each other, the vibrator units 5 are stored and fixed into the chambers 8 of the casing 6. In this case, first, while being supported by a jig, the vibrator units 5 are moved to be inserted into the chambers 8. Then, the vibrator units 5 are positioned in the state where the front end faces of the piezoelectric vibrators 2 are brought into contact with the island portions 9 of the elastic plate 12 respectively. After the positioning, an adhesive agent is poured between the back face of the fixation plate 3 and the inner wall of the casing 6 in the state where the vibrator units 5 have been positioned. Thus, the vibrator units 5 are bonded.

When the recording head 1 has been assembled, the manufacturing process advances to the measuring step. In this measuring step, an ink amount measuring step, an ink amount ratio calculating step and a natural vibration period determining step are carried out sequentially. In the ejected ink amount measuring step, ejected ink amounts are measured. In the ink amount ratio calculating step, an ink amount ratio is acquired on the basis of the ejected ink amounts obtained in the ejected ink amount measuring step. In the natural vibration period determining step, the natural vibration period Tc of the ink in the pressure chamber 14 is determined. These steps are carried out by use of a natural vibration period measuring apparatus shown in FIG. 3.

The illustrated natural vibration period measuring apparatus has an evaluation pulse generator 31, an electronic balance 32, and a controller 33. The evaluation pulse generator 31 serves as a driver for the piezoelectric vibrators 2. The electronic balance 32 serves as a liquid amount (liquid weight) instrument. The controller 33 is electrically connected to the evaluation pulse generator 31 and the electronic balance 32 to serve as a liquid amount ratio calculator and a natural vibration period determinant. The controller 33 comprises a CPU 33*a*, a ROM 33*b*, a RAM 33*c*, an information storage 33*d* (e.g. EEPROM), etc.

In the ejected ink amount measuring step according to this embodiment, the evaluation pulse generator 31 and the recording head 1 are electrically connected so that evaluation pulses TP generated by the evaluation pulse generator 31 are supplied to the piezoelectric vibrators 2. Thus, ink droplets are ejected from the recording head 1. Then, the weight of the ejected ink droplets is measured by the electronic balance 32.

Figure 4:
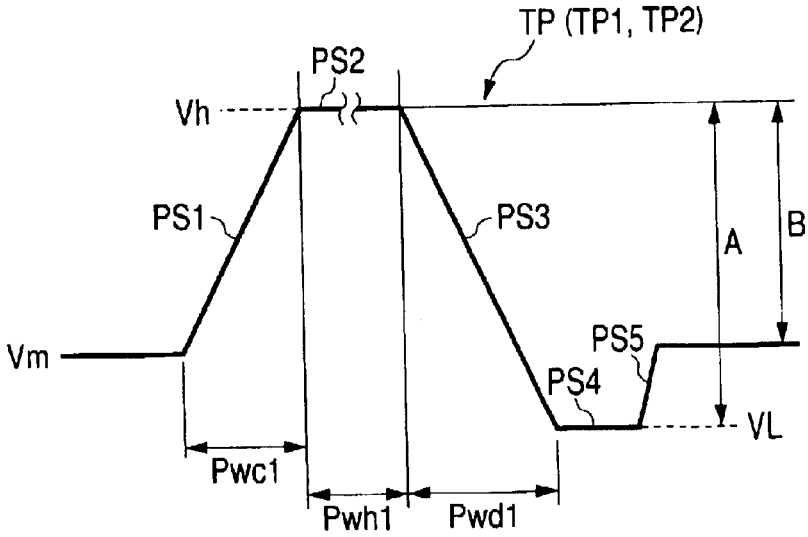
FIG. 4 is a diagram showing an evaluation pulse generated from an evaluation pulse generator in the measuring apparatus.

In the ejected ink amount measuring step, as shown in FIG. 4, the evaluation pulse generator 31 supplies a first evaluation pulse TP1 and a second evaluation pulse TP2 to the piezoelectric vibrators 2 respectively. In the first evaluation pulse TP1, a time interval Pwh1 between an excitation element P1 and an ejection element P3 is set to be a first time interval. In the second evaluation pulse TP2, the time interval Pwh1 is set to be a second time interval longer than the first time interval. Thus, a first ink amount IwS corresponding to the first evaluation pulse TP1 and a second ink amount IwL corresponding to the second evaluation pulse TP2 are measured. Incidentally, detailed description will be made later on these evaluation pulses TP1 and TP2.

In addition, when the evaluation pulses TP1 and TP2 are used, each ink droplet ejected from the recording head 1 has a small volume of about over ten picoliters (pL). Therefore, the weight of each droplet is about over ten nanograms (ng), and it is difficult to measure correct weight for every droplet. Accordingly, when the ink droplet weight is measured by the electronic balance 32, a plurality of ink droplets are ejected from the respective nozzle orifices 13, and the total weight of the droplets is measured. For example, ink droplets are ejected from the nozzle orifices 13 till the total number of times of ejection reaches 100,000 times, and the total weight of the droplets is measured.

Figure 5:
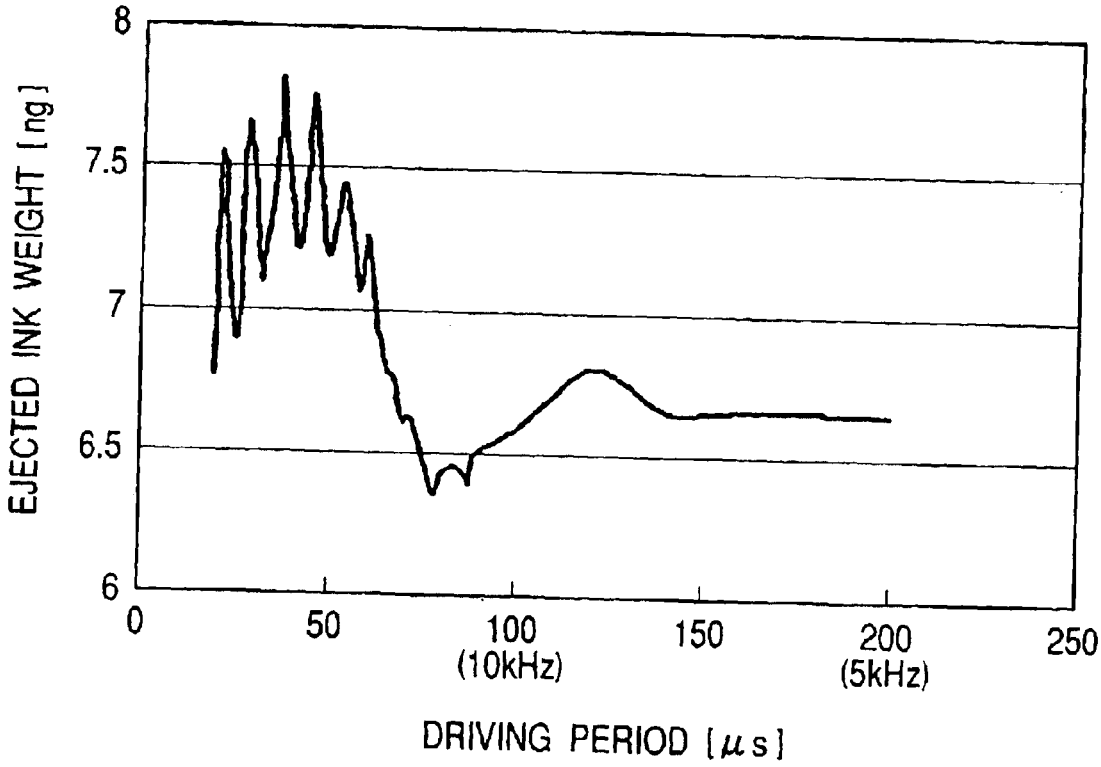
FIG. 5 is a graph showing the relationship between the supplying cycle of the evaluation pulse and the ejected ink amount.

In this case, it is preferable that the evaluation pulses TP1 and TP2 are supplied to the piezoelectric vibrators 2 at a low frequency not higher than 10 kHz, particularly at a low frequency not higher than 5 kHz. This is because there is a probability that the amount of ejected ink fluctuates due to the influence of frequency variation when the evaluation pulses TP1 and TP2 are supplied to the piezoelectric vibrators 2 at a high frequency higher than 10 kHz. FIG. 5 shows the relationship between the supplying cycle of the evaluation pulses and the ejected ink amount.

Then, the controller 33 acquires the measured ink weight as the first ink amount IwS or the second ink amount IwL. In this case, the controller 33 may acquire the measured ink weight directly as the first ink amount IwS or the second ink amount IwL. Alternatively, the ink weight of an ink droplet obtained by dividing the measured ink weight by the total number of times of ejection may be acquired as the first ink amount IwS or the second ink amount IwL. Incidentally, since it will go well if the amount of ejected ink is grasped, ejected ink droplets may be collected to measure the volume of the ink droplets.

In the ink amount ratio calculating step, the controller 33 calculates the ink amount ratio (first ink amount IwS/second ink amount IwL) on the basis of the weight information about the first ink amount IwS and the second ink amount IwL received from the electronic balance 32.

In the natural vibration period determining step, the natural vibration period Tc of the recording head 1 as a subject of measurement is determined on the basis of the correlation between the ink amount ratio and the natural vibration period Tc acquired in advance. That is, the controller 33 applies the acquired ink amount ratio to this correlation so as to determine the natural vibration period Tc. Incidentally, information indicating the correlation between the ink amount ratio and the natural vibration period Tc (correlation information) is stored in the ROM 33*b* or the information storage 33*d*.

Detailed description will be made on the ejected ink amount measuring step, the ink amount ratio calculating step and the natural vibration period Tc calculating step.

First, description will be made on the ejected ink amount measuring step. As described above, the evaluation pulses TP used in the ejected ink amount measuring step are pulse signals each having a waveform shown in FIG. 4. That is, each evaluation pulse TP is constituted by an excitation element PS1 for increasing the potential at a constant gradient from an intermediate potential Vm as a reference potential to maximum potential Vh, a first holding element PS2 generated following the excitation element PS1 so as to keep the maximum potential Vh, an ejection element PS3 generated following the first holding element PS2 so as to decrease the potential at a constant steep gradient from the maximum potential Vh to minimum potential VL, a second holding element PS4 generated following the ejection element PS3 so as to keep the minimum potential VL, and a damping element PS5 for increasing the potential at a constant gradient from the minimum potential VL to the intermediate potential Vm.

Figure 6A:
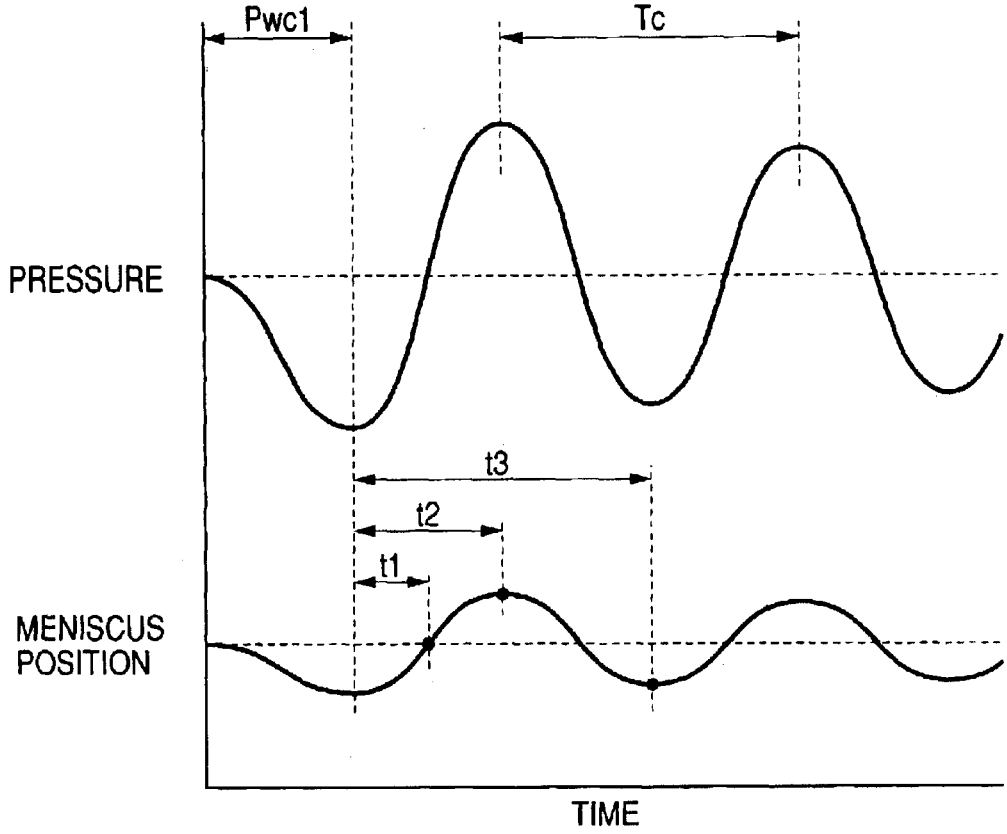
FIG. 6A is a diagram showing the pressure fluctuation of a pressure chamber and the position of a meniscus when an excitation element is supplied.

The excitation element PS1 is an element for exciting pressure vibration in the ink in the pressure chamber 14. When the excitation element PS1 is supplied to the piezoelectric vibrator 2, particularly when the excitation element PS1 is supplied and the maximum potential Vh is then kept, the pressure chamber 14 expands from a reference volume corresponding to the intermediate potential Vm to a maximum volume corresponding to the maximum potential Vh. While supplied with the maximum potential Vh, the pressure chamber 14 keeps the maximum volume. With this change of volume, the ink pressure in the pressure chamber 14 changes, for example, as shown in FIG. 6A. That is, when the pressure chamber 14 is expanded, the ink pressure in the pressure chamber 14 becomes lower than its stationary state. Then, when supplying of the excitation element PS1 is finished, ink flows into the pressure chamber 14 through the ink supply port 15 so that the ink pressure in the pressure chamber 14 increases to be higher than the stationary state. After that, the ink pressure in the pressure chamber 14 drops down to be lower than the stationary state. As a result, when the excitation element PS1 is supplied to the piezoelectric vibrator 2, pressure vibration having a natural vibration period Tc is excited in the ink in the pressure chamber 14.

The duration Pwc1 of the excitation element PS1, that is, the time when the excitation element PS1 is supplied to the piezoelectric vibrator 2 is set to be the time for allowing the pressure vibration of the natural vibration period Tc to be excited. Then, in order to excite the pressure vibration efficiently, the time Pwc1 is preferably set to be not longer than the designed value of the natural vibration period Tc of the ink in the pressure chamber 14, more preferably set to be not longer than a half of the designed value. Incidentally, since the designed value of the natural vibration period Tc is 7.2 $\mu$s in the recording head 1 according to this embodiment, the duration Pwc1 of the excitation element PS1 is set at 3.5 $\mu$s approximately equivalent to ½ of the designed value.

The ejection element PS3 is an element for contracting the pressure chamber 14 rapidly to apply pressure to the ink and thereby eject an ink droplet from the nozzle orifice 13. When the ejection element PS3 is supplied to the piezoelectric vibrator 2, the pressure chamber 14 is contracted rapidly from the maximum volume corresponding to the maximum potential Vh to a minimum volume corresponding to the minimum potential VL. With this rapid contraction of the pressure chamber 14, the ink pressure in the pressure chamber 14 increases rapidly so that an ink droplet is ejected from the nozzle orifice 13.

Then, the duration Pwd1 of the ejection element PS3 is set to be the time for obtaining pressure required for ejecting an ink droplet. In the case of the recording head 1 using the piezoelectric vibrator 2, the duration Pwd1 is preferably set to be equal to the designed value of the natural vibration period Ta of the piezoelectric vibrator 2. Since the designed value of the natural vibration period Ta is approximately a half of the natural vibration period Tc in this embodiment, the duration Pwd1 is set to be as long as the duration Pwc1 of the excitation element PS1.

The first holding element PS2 is an element for making connection between the end of the excitation element PS1 and the start of the ejection element PS3 at the same potential, and defining the time interval between the excitation element PS1 and the ejection element PS3, in other words, the supply timing of the ejection element PS3. Then, when the time width Pwh1 of the first holding element PS2 is changed, the amount of ejected ink is changed. This is because the pressure vibration of the natural vibration period Tc occurs in the ink in the pressure chamber 14 due to the supply with the excitation element PS1.

This point will be described below. When the excitation element PS1 is supplied to the piezoelectric vibrator 2 and the vibrator potential is kept at the maximum potential Vh, the ink pressure in the pressure chamber 14 varies up and down periodically in accordance with the natural vibration period Tc of the recording head 1 as schematically shown in FIG. 6A. Then, the state of a meniscus also changes due to the periodic variation of the ink pressure.

Figure 6B:
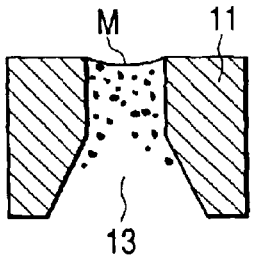
FIGS. 6B to 6D are views for explaining the position of the meniscus when the excitation element is supplied.
Figure 6C:
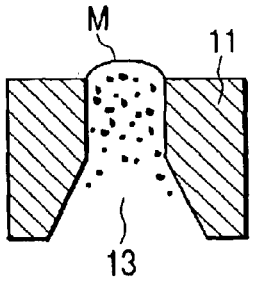
Figure 6D:
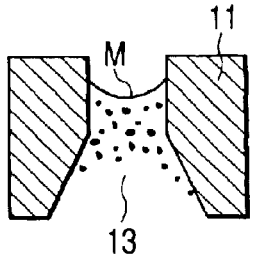

For example, when the ink in the pressure chamber 14 is in the stationary pressure, the meniscus M stands still in substantially the same position as the nozzle face (outside face of the nozzle plate 11) as shown in FIG. 6B. Then, when the ink pressure is higher than the stationary pressure, the meniscus M protrudes to the outside (the side where an ink droplet is ejected) with respect to the nozzle face as shown in FIG. 6C. On the contrary, when the ink pressure is lower than the stationary pressure, the meniscus M is retracted to the pressure chamber 14 side as shown in FIG. 6D.

Then, the amount of ejected ink is established by the state of the meniscus M at the supply timing of the ejection element PS3. For example, assume that a reference amount is an ink amount in the state shown in FIG. 6B, that is, when the ejection element PS3 is supplied in the stationary state of the meniscus. In this case, in the state where the meniscus has protruded as shown in FIG. 6C, the ejected ink amount becomes larger than the reference amount correspondingly to the protruded degree from the stationary state. On the other hand, in the state where the meniscus has been retracted as shown in FIG. 6D, the ejected ink amount becomes smaller than the reference amount correspondingly to the degree with which the meniscus has been retracted from the stationary state.

It can be considered that this is because the energy applied from the piezoelectric vibrator 2 is much larger than the vibration energy of the ink in the pressure chamber 14 caused by the supply with the excitation element PS1. That is, it can be considered that when the pressure fluctuation caused by the piezoelectric vibrator 2 is much larger than the pressure vibration of the ink, the contraction speed or contraction amount of the pressure chamber 14 at the time of ejection of an ink droplet is hardly affected by the pressure vibration of the ink, and the difference in position of the meniscus M appears as the difference in ink amount.

Then, as shown in FIG. 6A, the state of the meniscus M changes periodically with the variation of the ink pressure in the pressure chamber 14. Therefore, when the time interval Pwh1 of the first holding element PS2 is set to be t1, the meniscus M is brought into the stationary state so that an ink droplet of the reference ink amount is ejected. When the time interval Pwh1 is set to be t2, the meniscus M is protruded so that an ink droplet having a larger amount than the reference ink amount is ejected. Further, when the time interval Pwh1 is set to be t3, the meniscus M is retracted so that an ink droplet having a smaller amount than the reference ink amount is ejected. Accordingly, when the ejected ink amount is measured by use of each of the evaluation pulses TP1 and TP2, an ink amount corresponding to the time interval of the first holding element PS2 can be obtained.

Figure 7:
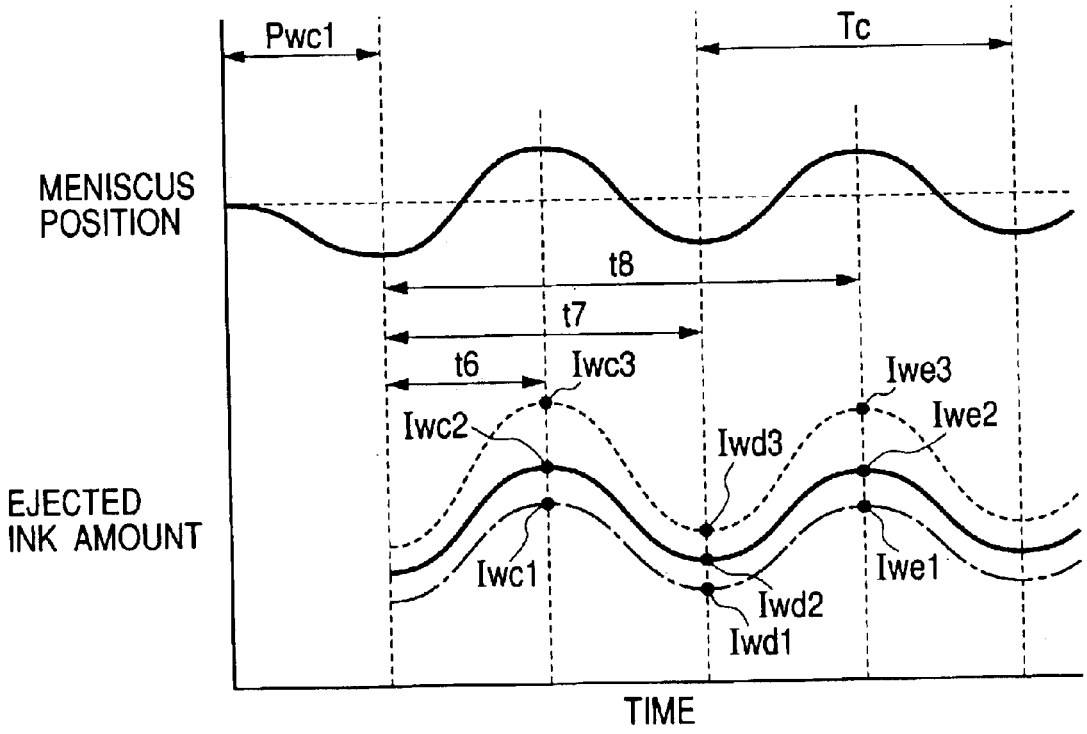
FIG. 7 is a diagram showing the relationship between the position of the meniscus and the ejected ink amount.
Figure 8:
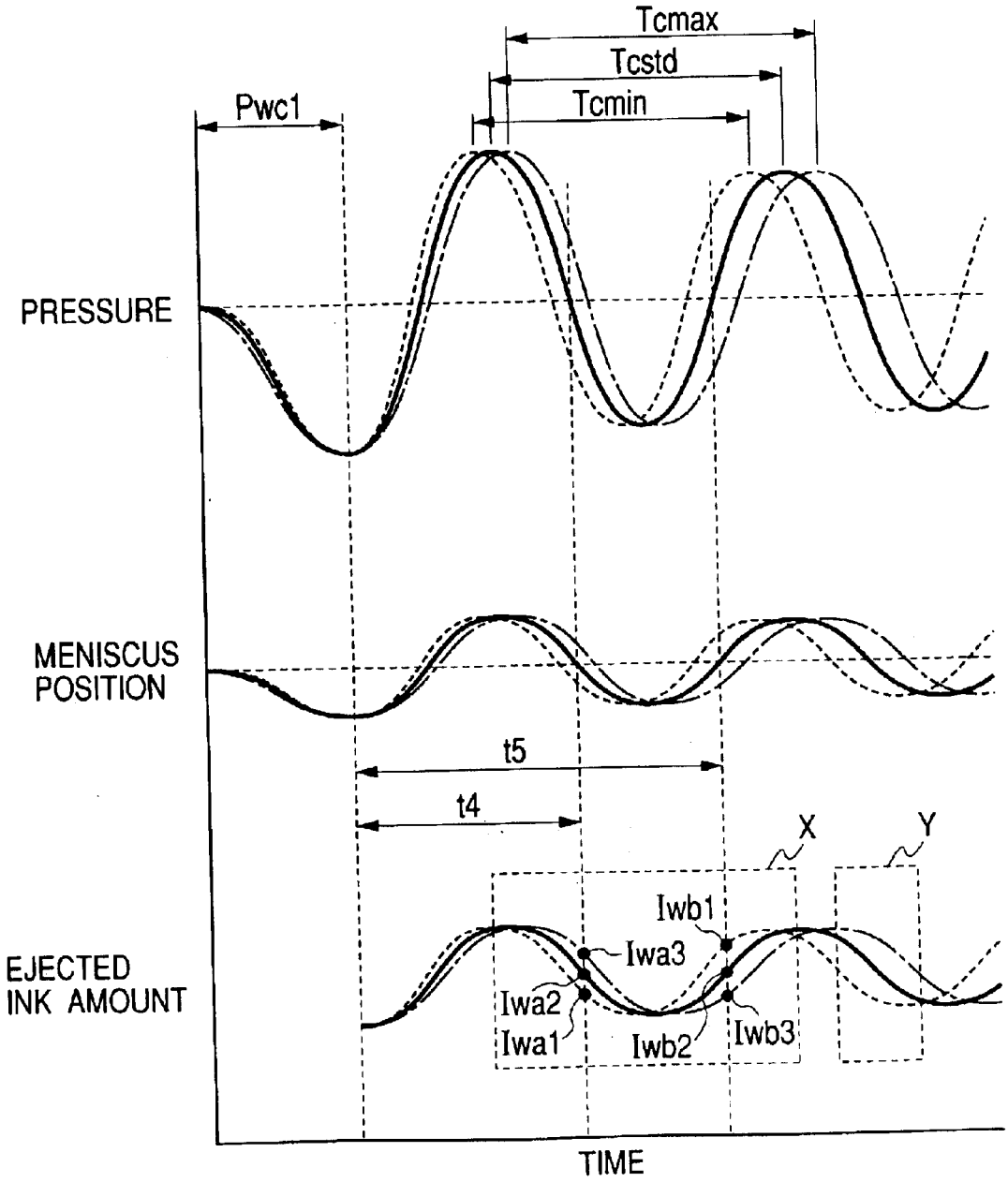
FIG. 8 is a diagram showing the relationship among the pressure fluctuation in a pressure chamber, the position of a meniscus and the ejected ink amount concerning a plurality of recording heads different in natural vibration period.

However, in the recording head 1, there occurs a variation in the natural vibration period Tc of the ink in the pressure chamber 14 due to cumulative tolerance of dimensional accuracy or setting accuracy of the vibrator units 5 or the channel unit 7. In addition, even if the natural vibration period Tc is fixed, actuating force (pushing force or pulling force) generated from each piezoelectric vibrator 2 varies for every vibrator unit 5. Then, when there is a deviation in the natural vibration period Tc, the pressure fluctuation period of the ink gets longer or shorter, and the vibration cycle of the meniscus M also gets longer of shorter correspondingly, as shown in FIG. 8. Thus, the amount of ejected ink also varies synchronously with the vibration period of the meniscus M. As a result, even when the supply timing of the ejection element PS3 is fixed, the ejected ink amount differs in accordance with the natural vibration period Tc of the recording head 1. In addition, when the actuating force from the piezoelectric vibrator 2 varies, the ejected ink amount differs in spite of the same variation period of the ejected ink amount as shown in FIG. 7. These points will be described below.

First, description will be made on the point that the ejected ink amount varies in accordance with the difference of the natural vibration period Tc. Three kinds of recording heads 1, that is, a standard recording head having a natural vibration period Tc as designed, a recording head having a maximum natural vibration period Tc that can be established in the manufacturing process, and a recording head having a minimum natural vibration period Tc that can be established in the manufacturing process, will be described by way of example.

In the following description, for the sake of convenience, the natural vibration period Tc as designed will be referred to as a "standard natural vibration period Tcstd", and the recording head 1 having the standard natural vibration period Tcstd will be referred to as a "standard period recording head". The maximum natural vibration period Tc that can be established in the manufacturing process will be referred to as a "maximum natural vibration period Tcmax", and the recording head 1 having the maximum natural vibration period Tcmax will be referred to as a "maximum period recording head". The minimum natural vibration period Tc that can be established in the manufacturing process will be referred to as a "minimum natural vibration period Tcmin", and the recording head 1 having the minimum natural vibration period Tcmin will be referred to as a "minimum period recording head".

In addition, in order to sort each assembled recording head 1 in accordance with the standard period recording head, the maximum period recording head and the minimum period recording head, it is necessary to measure its natural vibration period Tc in another method. For example, the natural vibration period Tc is measured by measuring a variation period in an ink amount variation curve.

The ejected ink amount variation curve means curves represented by the solid line, the chain double-dashed line or the dotted line in the lower half of FIG. 7, which show the relationship between the time interval Pwh1 of the first holding element PS2 and the ejected ink amount. This ink amount variation curve can be obtained, for example, by forming a measuring signal for each of a plurality of kinds of evaluation pulses TP whose time intervals Pwh1 are finely made different stepwise, and measuring the ejected ink amount by use of each measuring signal. In the illustrated ink amount variation curves, the ejected ink amount increases and decreases periodically with the increase of the time interval Pwh1. Then, such an ink amount variation curve can be approximated by the following expression (1).

$$Iw = A\sin\left(\frac{2\pi t}{Tc} + \alpha\right) + O \quad (1)$$

In this expression (1), Iw designates the ink droplet (liquid droplet) weight, A designates the vibration weight amplitude, α designates the initial phase term, and ○ designates the base weight. Incidentally, the aforementioned term A corresponds to the potential difference A (see FIG. 4) of the ejection element PS3.

As is understood from FIGS. 7 and 8, the variation period of the ejected ink amount variation curve corresponds to the natural vibration period Tc in the corresponding recording head 1. That is, in the standard period recording head, the ink pressure in the pressure chamber 14, the position of the meniscus M, and the ejected ink amount vary periodically in the standard natural vibration period Tcstd respectively as shown by the solid line in FIG. 8. In the maximum period recording head, the ink pressure in the pressure chamber 14, the position of the meniscus M, and the ejected ink amount vary periodically in the maximum natural vibration period Tcmax respectively as shown by the chain double-dashed line in FIG. 8. Further, in the minimum period recording head, the ink pressure in the pressure chamber 14, the position of the meniscus M, and the ejected ink amount vary periodically in the minimum natural vibration period Tcmin respectively as shown by the dotted line in FIG. 8.

Accordingly, if the time interval between two bottom points or two peak points adjacent to each other in the ejected ink amount variation curve is measured, the natural vibration period Tc of the recording head 1 can be measured.

Incidentally, in the following description, for the sake of convenience, the ejected ink amount variation curve of the standard period recording head will be referred to as a "standard period variation curve". Similarly, the ejected ink amount variation curve of the maximum period recording head will be referred to as a "maximum period variation curve", and the ejected ink amount variation curve of the minimum period recording head will be referred to as a "minimum period variation curve".

Then, the difference in the natural vibration period Tc of the recording head 1 results in difference in the ejected ink amount even when the duration Pwh1 of the first holding element PS2 is fixed. For example, when the duration Pwh1 of the first holding element PS2 is set to be t4, the ejected ink amount Iwa3 in the maximum period recording head becomes larger than the ejected ink amount Iwa2 in the standard period recording head. On the other hand, the ejected ink amount Iwa1 in the minimum period recording head becomes smaller than the ejected ink amount Iwa2 in the standard period recording head. On the contrary, when the duration Pwh1 of the first holding element PS2 is set to be t5, the ejected ink amount Iwb3 in the maximum period recording head becomes smaller than the ejected ink amount Iwb2 in the standard period recording head. On the other hand, the ejected ink amount Iwb1 in the minimum period recording head becomes larger than the ejected ink amount Iwb2 in the standard period recording head.

Next, description will be made on the case where the actuating force from the piezoelectric vibrator 2 changes. In this case, as described above, there occurs a difference in the ejected ink amount though the variation period of the ejected ink amount is fixed. For example, when a vibrator unit 5 having piezoelectric vibrators 2 with standard force is used, the ejected ink amount varies periodically as shown in the solid-line ink amount variation curve of FIG. 7. When a vibrator unit 5 having piezoelectric vibrators 2 with stronger force than the standard force is used, the ejected ink amount variation curve rises as a whole in comparison with the ejected ink amount variation curve using the standard vibrator unit 5, and the variation width of the ejected ink amount is enlarged in proportion to the rising of the curve, as shown in the dotted line in FIG. 7. On the contrary, when a vibrator unit 5 having piezoelectric vibrators 2 with weaker force than the standard force is used, the ejected ink amount variation curve sinks as a whole in comparison with the ejected ink amount variation curve using the standard vibrator unit 5, and the variation width of the ejected ink amount is made small in proportion to the sinking of the curve, as shown in the chain double-dashed line in FIG. 7.

Accordingly, even when there is a difference in the actuating force from the piezoelectric vibrator 2, there occurs a difference in the ejected ink amount in spite of the fixed duration Pwh1 of the first holding element PS2, in the same manner as when there is a difference in the natural vibration period Tc.

From the above description, it is understood that when the duration Pwh1 of the first holding element PS2 is fixed to be a constant time, the ejected ink amount varies in accordance with the natural vibration period Tc of the ink in the recording head 1, but it also varies in accordance with the characteristic of the vibrator unit 5 or the like. Therefore, when the ejected ink amount is measured by use of only one evaluation pulse TP, the difference of the ejected ink amount from its designed value can be known, but it cannot be judged whether the difference is caused by the difference of the natural vibration period Tc or by the characteristic difference of the vibrator unit 5.

Therefore, in this embodiment, the first ink amount IwS and the second ink amount IwL are measured in the ejected ink amount measuring step, the ink amount ratio (IwS/IwL) is obtained from the first and second ejected ink amounts IwS and IwL in the ink amount ratio calculating step, and the natural vibration period Tc of the recording head 1 as a subject of measurement is determined from the correlation between the ink amount ratio and the natural vibration period Tc in the natural vibration period determining step. This point will be described below.

Among a plurality of ink amount variation curves different in characteristic of the vibrator unit 5, the amplitude thereof varies in proportion to the variation of the base level (e.g. average ink amount) as described above. In addition, the vibration periods of the ejected ink amount variation curves are identical regardless of the characteristic of the vibrator unit 5. Accordingly, if the natural vibration period Tc is fixed, the ink amount ratio will take a substantially fixed value even when the base level varies.

On the other hand, the fluctuation periods of a plurality of ink amount variation curves different in natural vibration period Tc are not identical. Accordingly, when there is a difference in natural vibration period Tc, the ink amount ratio varies in accordance with the natural vibration period Tc.

For example, as shown in FIG. 7, in the case where there is a difference in characteristic of the vibrator unit 5, the relationship of the following expression (2) is established among the ejected ink amounts Iwc1, Iwc2 and Iwc3 measured when the duration Pwh1 of the first holding element PS2 is set to be t6 and the ejected ink amounts Iwd1, Iwd2 and Iwd3 measured when the duration Pwh1 is set to be t7.

$$\frac{Iwc1}{Iwd1} = \frac{Iwc2}{Iwd2} = \frac{Iwc3}{Iwd3} \quad (2)$$

In addition, the relationship of the following expression (3) is established among the ejected ink amounts Iwd1, Iwd2 and Iwd3 and the ejected ink amounts Iwe1, Iwe2 and Iwe3 measured when the duration Pwh1 of the first holding element PS2 is set to be t8.

$$\frac{Iwd1}{Iwe1} = \frac{Iwd2}{Iwe2} = \frac{Iwd3}{Iwe3} \quad (3)$$

Similarly, the relationship of the following expression (4) is established among the ejected ink amounts Iwc1, Iwc2 and Iwc3 and the ejected ink amounts Iwe1, Iwe2 and Iwe3.

$$\frac{Iwc1}{Iwe1} = \frac{Iwc2}{Iwe2} = \frac{Iwc3}{Iwe3} \quad (4)$$

On the other hand, assume that there is a difference in natural vibration period Tc. In this case, as shown in FIG. 8, when the duration Pwh1 of the first holding element PS2 is set to be t4 and t5 so as to measure the ejected ink amount therewith, that is, when the ejected ink amounts Iwa1 and Iwb1 corresponding to the minimum period recording head, the ejected ink amounts Iwa2 and Iwb2 corresponding to the standard period recording head and the ejected ink amounts Iwa3 and Iwb3 corresponding to the maximum period recording head are measured, the relationship of the following expression (5) is established.

$$\frac{Iwa1}{Iwb1} < \frac{Iwa2}{Iwb2} < \frac{Iwa3}{Iwb3} \quad (5)$$

As for the ejected ink amounts Iwa1, Iwa2 and Iwa3, Iwa1 is smaller than Iwa2, and Iwa2 is smaller than Iwa3. Then, since Iwa1 is an ink amount in the minimum natural vibration period Tcmin and Iwa3 is an ink amount in the maximum natural vibration period Tcmax, the ejected ink amount when the duration Pwh1 is set to be t4 increases with the increase of the natural vibration period Tc.

On the other hand, as for the ejected ink amounts Iwb1, Iwb2 and Iwb3, Iwb1 is larger than Iwb2, and Iwb2 is larger than Iwb3. Then, since Iwb1 is an ink amount in the minimum natural vibration period Tcmin and Iwb3 is an ink amount in the maximum natural vibration period Tcmax, it can be said that the ejected ink amount when the duration Pwh1 is set to be t5 decreases with the increase of the natural vibration period Tc.

Accordingly, there is a one-to-one correspondence between the ink amount ratio (Iwa/Iwb) acquired when the duration Pwh1 of the first holding element PS2 is set to be t4 and t5, and the natural vibration period Tc of the ink in the recording head 1.

As is apparent from the above description, the ink amount ratio of the first ink amount IwS to the second ink amount IwL acquired in the ink amount ratio calculating step becomes a parameter varying in accordance with the difference in the natural vibration period Tc of the ink in the pressure chamber 14 because the variation in ink amount caused by the characteristic of the vibrator unit 5 or the like is ignored.

Accordingly, if the correlation between the ink amount ratio (IwS/IwL) and the natural vibration period Tc is acquired in advance, the natural vibration period Tc in an assembled recording head 1 can be determined from the ejected ink amounts (that is, ink amount ratio) of the recording head 1.

Figure 9:
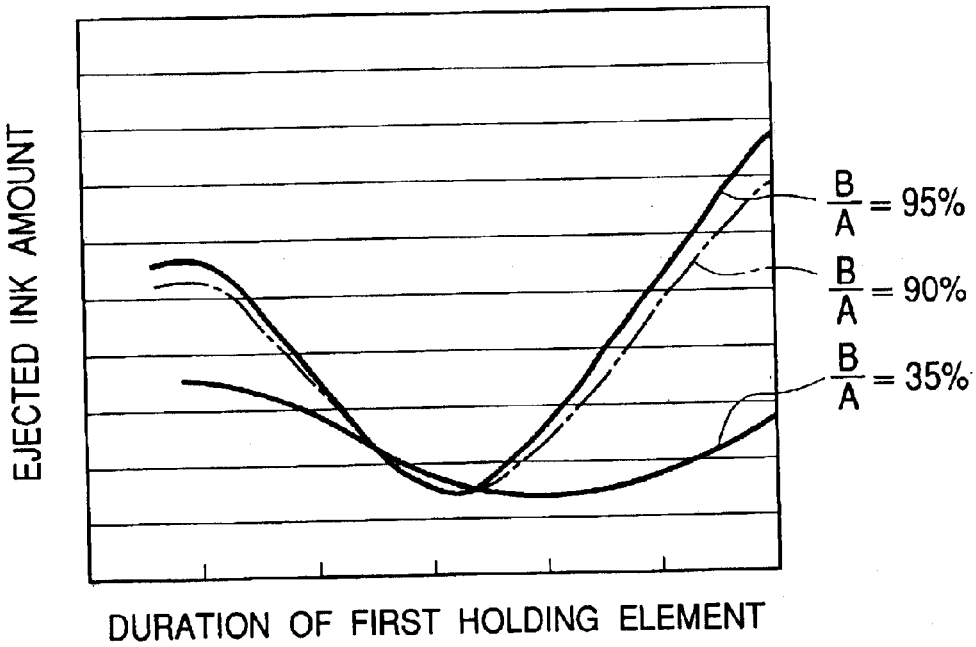
FIG. 9 is a graph showing the relationship between the duration of a first holding element in the evaluation pulse and the ejected ink amount, when the potential difference of an excitation element in the evaluation pulse is changed.

In this case, the following finding could be obtained. That is, the larger the potential difference of the excitation element PS1 is, that is, the steeper the potential gradient of the excitation element PS1 is, the larger the amplitude in the ejected ink amount variation curve is. It can be considered that this is because the amplitude of the meniscus M becomes larger as the potential difference of the excitation element PS1 is larger. For example, as shown in FIG. 9, when the case where the ratio (B/A, see FIG. 4) of the potential difference B of the excitation element PS1 to the potential difference A of the ejection element PS3 was set at 95% and the case where the ratio was set at 35% were compared with each other, the change of the ejected ink amount in the case where the ratio was set at 95% was more remarkable. When the change of the ejected ink amount is remarkable like this, a slight difference in natural vibration period Tc can be reflected by the ink amount ratio change. It is therefore possible to preferably improve the sensitivity to detect the natural vibration period Tc. Then, from this experimental result, it can be said that the ratio of the potential difference B of the excitation element PS1 to the potential difference A of the ejection element PS3 is preferably not lower than 90%, more preferably not lower than 95%.

In addition, as for the two kinds of evaluation pulses TP1 and TP2 used for calculating the natural vibration period Tc, the time interval Pwh1 (first time interval and second time interval) of the first holding element PS2 in each of the evaluation pulses TP1 and TP2, that is, the supply timing of the ejection element PS3 may be set arbitrarily. However, the detection accuracy with which the natural vibration period Tc is detected differs in accordance with how to select the time interval Pwh1 of the first holding element PS2. For example, when the difference between the first time interval and the second time interval is set to be relatively small, the variation of the ink amount ratio relative to the variation of the natural vibration period Tc becomes small. Thus, the detection sensitivity becomes low.

Figure 10:
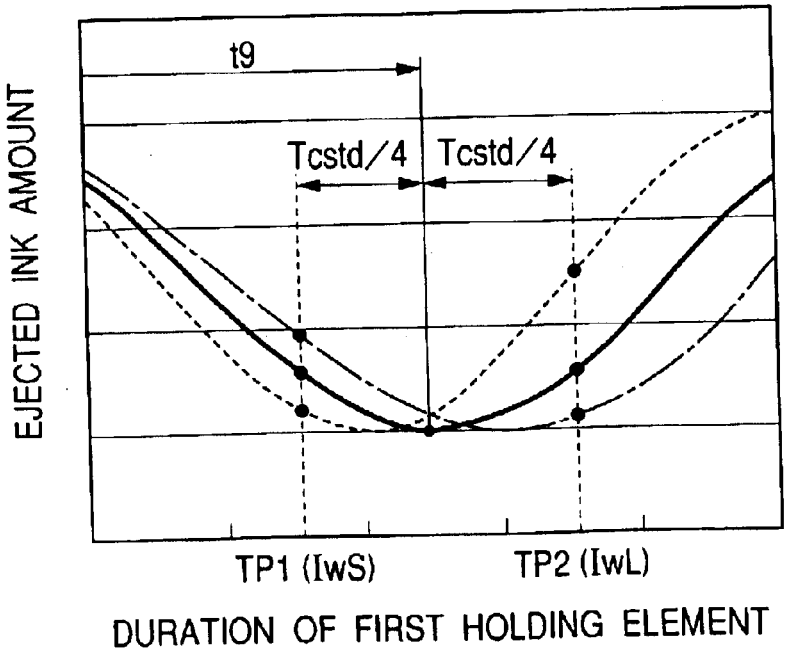
FIG. 10 is a graph for explaining how to prepare first and second evaluation pulses.

In this embodiment, as shown in FIG. 10, the time interval Pwh1 (first time interval and second time interval) is set so that the supply timing of the ejection element PS3 is in a range of from a peak point of the maximum period variation curve to a nearest peak point of the minimum period variation curve. In other words, the time interval Pwh1 is set in an overlapping range belonging to a range between two adjacent peak points in the maximum period variation curve and belonging to a range between two adjacent peak points in the minimum period variation curve.

When the time interval Pwh1 is set in this range, the ejected ink amount variation curve of the recording head 1 as a subject of measurement exists between the maximum period variation curve and the minimum period variation curve. Thus, the natural vibration period Tc in the recording head 1 can be determined from the ink amount ratio (IwS/IwL) with high accuracy.

More specifically, in the aforementioned range, the time interval Pwh1 (time interval t9) to supply the ejection element PS3 at a bottom point of the standard period variation curve is regarded as a standard time interval. The first time interval is set to be a time interval obtained by subtracting a quarter of the standard natural vibration period Tcstd from the standard time interval, while the second time interval is set to be a time interval obtained by adding a quarter of the standard natural vibration period Tcstd to the standard time interval. By this setting, the median between the first and second time intervals is matched with the standard time interval.

When setting is thus done, in the recording head 1 having the standard natural vibration period Tcstd, the ejected ink amount IwS corresponding to the first evaluation pulse TP1 is substantially equal to the ejected ink amount IwL corresponding to the second evaluation pulse TP2 so that the ink amount ratio (IwS/IwL) becomes close to the value 1.000. In the recording head 1 having a natural vibration period Tc shorter than the standard natural vibration period Tcstd, the ejected ink amount IwS is smaller than the ejected ink amount IwL so that the ink amount ratio becomes smaller than the value 1.000. In addition, in the recording head 1 having a natural vibration period Tc longer than the standard natural vibration period Tcstd, the ejected ink amount IwS is larger than the ejected ink amount IwL so that the ink amount ratio becomes larger than the value 1.000.

Incidentally, the difference between the standard time interval and the first time interval and the difference between the standard time interval and the second time interval are not limited to those in the aforementioned example, but may be set appropriately. The natural vibration period Tc can be measured properly if there is a difference to be at least about 0.1 time (0.1 Tcstd) of the standard natural vibration period Tc.

Next, description will be made on the step of determining the natural vibration period Tc from the ink amount ratio (IwS/IwL), that is, the natural vibration period determining step.

Figure 11:
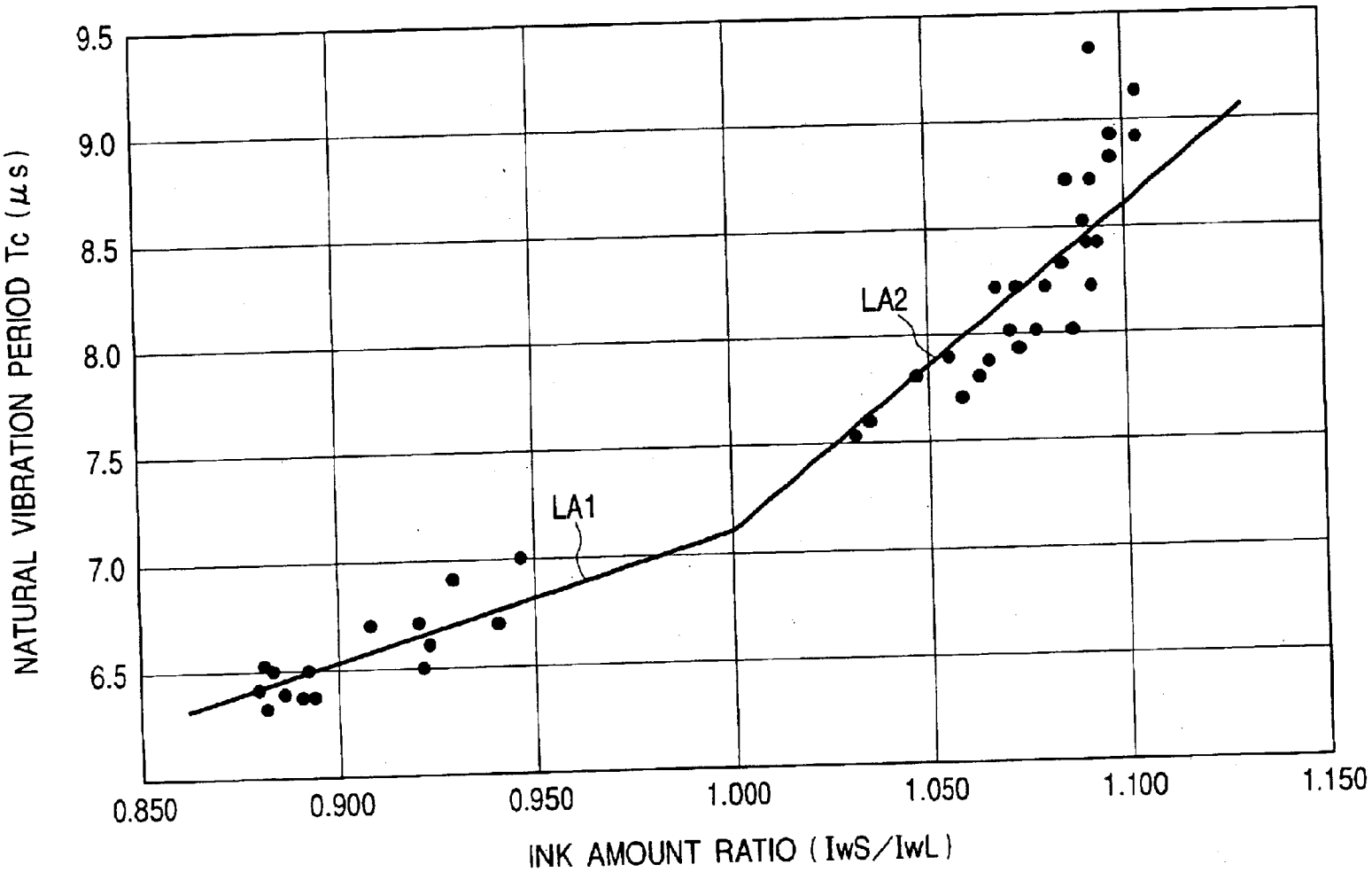
FIG. 11 is a graph showing the relationship between the natural vibration period and the ink amount ratio concerning a plurality of recording heads, showing an example in which the correlation therebetween is approximated by two linear expressions.

Here, FIG. 11 is a graph in which the ordinate designates the natural vibration period Tc and the abscissa designates the ink amount ratio, showing the relationship between the natural vibration period Tc and the ink amount ratio in a plurality of recording heads 1. From this figure, it is understood that there is a high correlation between the natural vibration period Tc and the ink amount ratio. That is, as the natural vibration period Tc is shorter than its designed value, the value of the ink amount ratio is smaller. On the contrary, as the natural vibration period Tc is longer than the designed value, the value of the ink amount ratio is larger. In addition, as the natural vibration period Tc is closer to the designed value (7.2 $\mu$s), the ink amount ratio is closer to the value 1.000.

Further, it is understood that the correlation between the natural vibration period Tc and the ink amount ratio can be expressed by a linear expression using the ink amount ratio as a variable. In other words, the relationship between the natural vibration period Tc and the ink amount ratio can be expressed by a linear calibration line.

In this case, the whole range of the ink amount ratio can be approximated by a single linear expression. However, in this example, there is a significant difference between the smaller ink amount ratio side and the larger ink amount ratio side bordering on the value 1.000 (corresponding to the standard ink amount ratio) of the ink amount ratio. It is therefore preferable that a linear expression is established for each of the range smaller than the value 1.000 and the range not smaller than the value 1.000. For example, the range smaller than the value 1.000 is approximated by a linear expression corresponding to a calibration line LA1 while the range not smaller than the value 1.000 is approximated by a linear expression corresponding to a calibration line LA2. In such a manner, when a linear expression (LA1, LA2) is set for each of a plurality of ranges, the natural vibration period Tc can be acquired more accurately than when the whole range is approximated by a single linear expression.

Figure 12:
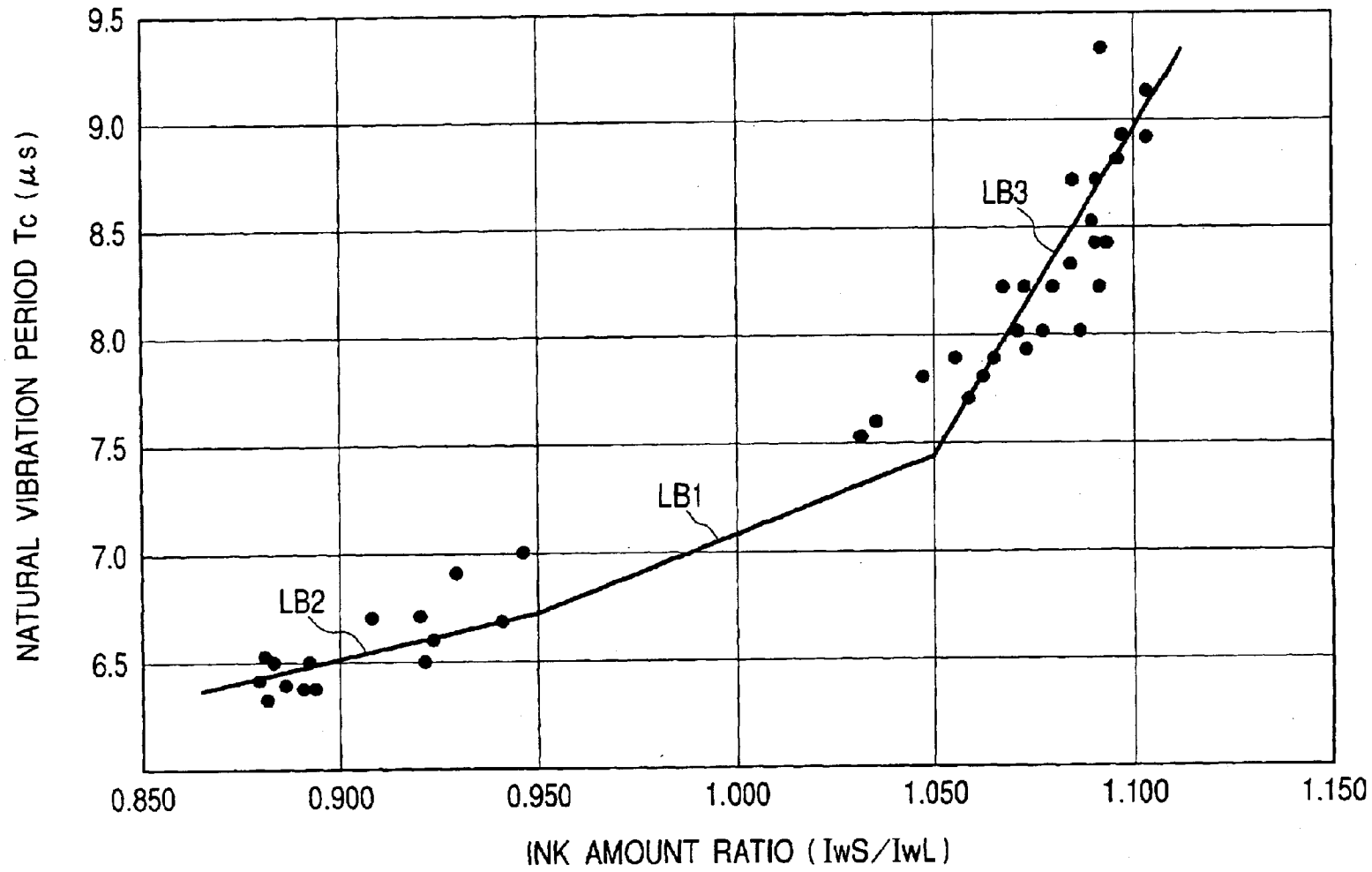
FIG. 12 is a graph showing the relationship between the natural vibration period and the ink amount ratio concerning a plurality of recording heads, showing an example in which the correlation therebetween is approximated by three linear expressions.

From this point of view, as shown in FIG. 12, the range of the ink amount ratio may be divided into a standard range set around the value 1.000 to be not smaller than the value 0.950 and to be smaller than 1.050, a range smaller than this standard range, and a range larger than the standard range so that a linear expression (calibration lines LB1-LB3) is set for each of the ranges. In such a manner, the natural vibration period Tc can be acquired more accurately.

Thus, since there is a high correlation between the ink amount ratio (IwS/IwL) and the natural vibration period Tc, the natural vibration period Tc can be acquired simply and easily from the ink amount ratio if linear expressions (calibration lines LA1-LA2 or LB1-LB3) are established in advance using some samples and stored in the ROM or EEPROM of the controller 33. That is, the controller 33 carries out a calculation of substituting the ink amount ratio into the linear expressions so that the natural vibration period Tc of the recording head 1 can be acquired. Then, in this method, there is a one-to-one correspondence between the ink amount ratio and the natural vibration period Tc, so that the natural vibration period Tc can be acquired accurately.

When the natural vibration period Tc of the assembled recording head 1 has been measured, the process advances to the information providing step, in which information indicating the obtained natural vibration period Tc (ID information) is provided for the recording head 1.

Figure 13A:
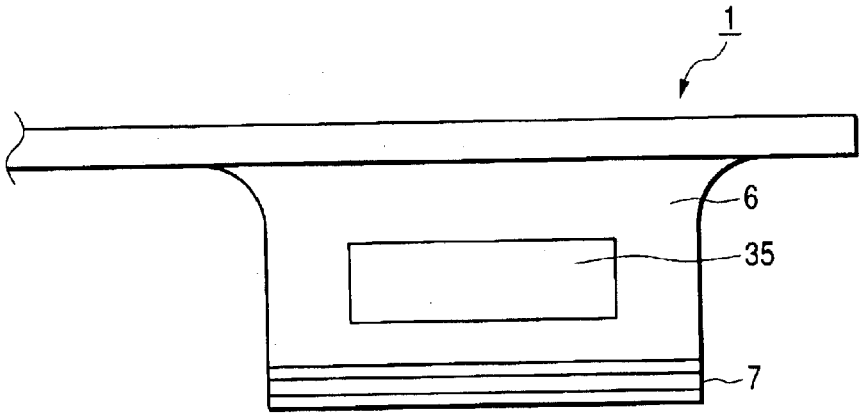
FIG. 13A is a side view of the liquid jetting head provided with an adhesive seal on which ID information is assigned.

In this information providing step, for example, the value of the obtained natural vibration period Tc is used as the ID information. Then, as shown in FIG. 13A, the value of the natural vibration period Tc is written on an adhesive seal 35 (which is a kind of indicator) in an optically readable form such as characters or bar codes, and this adhesive seal 35 is stuck onto the casing surface (for example, side face).

Figure 13B:
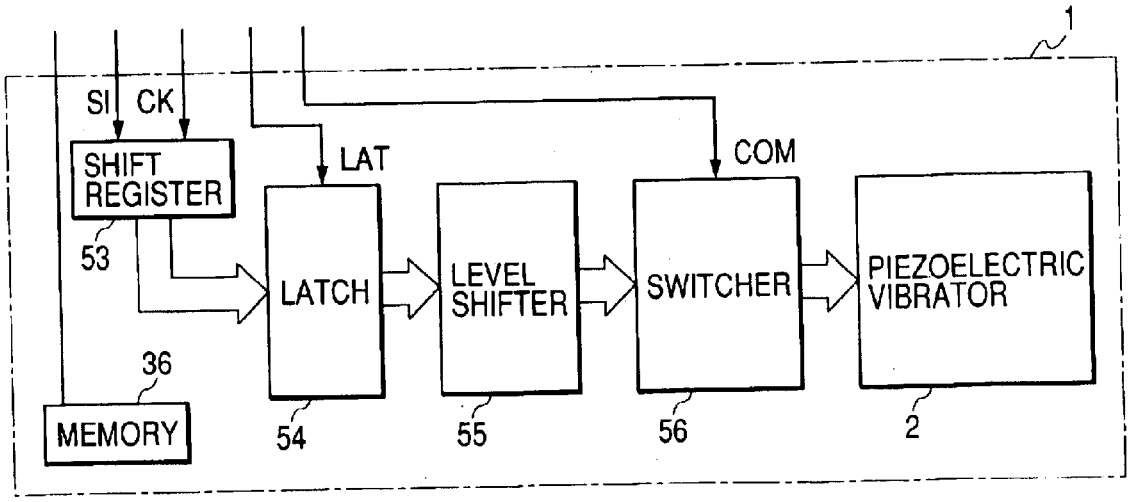
FIG. 13B is a block diagram of the liquid jetting head provided with a memory in which ID information is assigned.

Alternatively, as shown in FIG. 13B, the value of the natural vibration period Tc may be stored in a memory 36 (which is a kind of ID information storage) such as a ROM provided in the recording head 1. That is, the ID information indicating the natural vibration period Tc is provided for the recording head 1 through an information providing medium such as the adhesive seal 35 or the memory 36.

As described above, there is a one-to-one correspondence between the ink amount ratio and the natural vibration period Tc. Therefore, the value of the ink amount ratio may be used as the ID information.

According to the manufacturing method described above, the ejected ink amount is measured by use of two kinds of evaluation pulses TP1 and TP2 different in duration Pwh1 of the first holding element PS2. Thus, the natural vibration period Tc in the recording head 1 can be measured. In addition, this measurement of the ejected ink amount is simple and easy, and easy to support automation. Thus, the manufacturing method is suitable for mass production.

Figure 23:
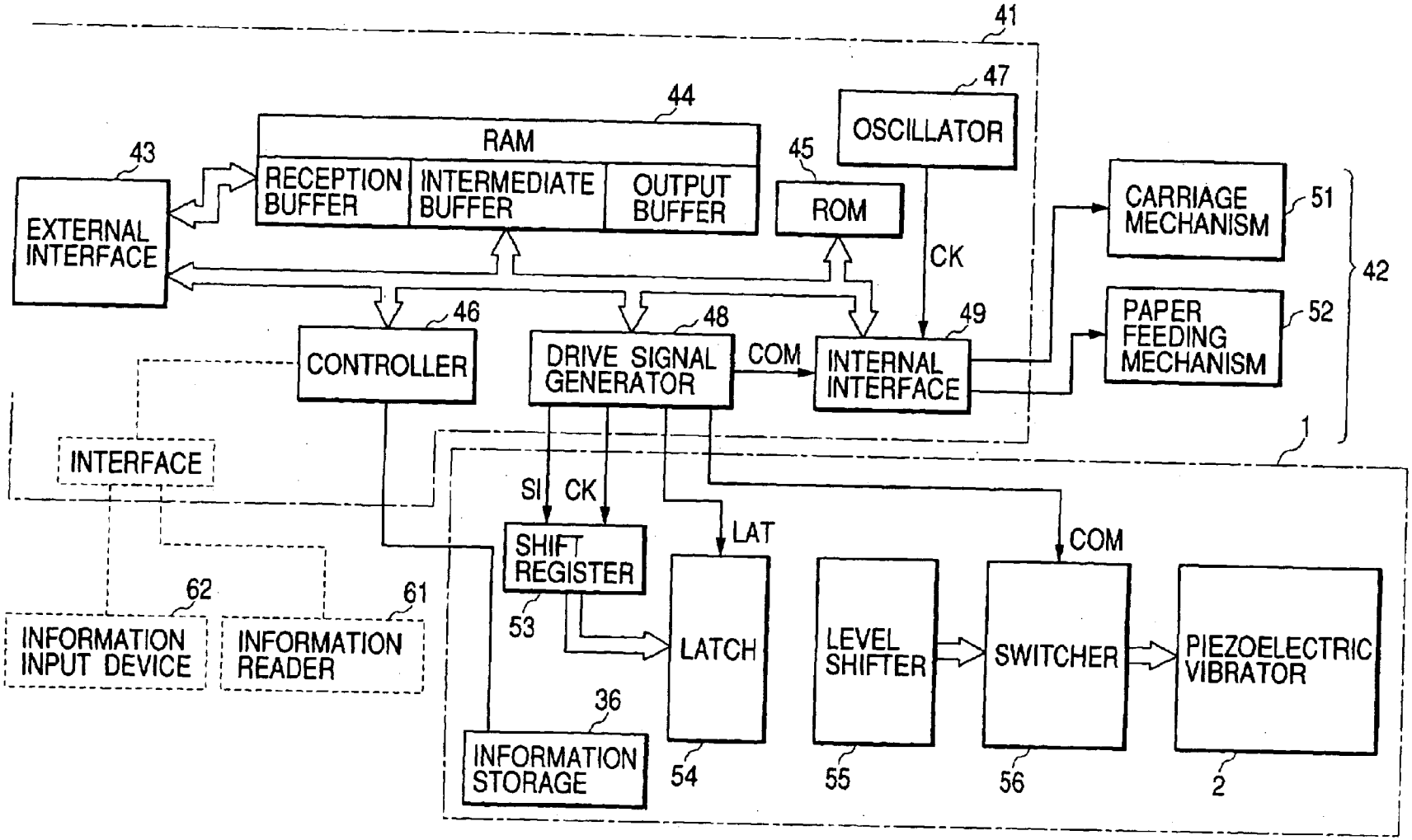
FIG. 23 is a block diagram for explaining the configuration of an ink jet printer which is one embodiment of a liquid jetting apparatus of the invention.

Next, description will be made on how to use the natural vibration period Tc determined in the aforementioned procedure. Here, FIG. 23 is a block diagram for explaining the electric configuration of an ink jet printer which is a kind of liquid jetting apparatus.

First, description will be made on the configuration of the printer. The illustrated printer has a printer controller 41 and a print engine 42. The printer controller 41 comprises an external interface 43 for receiving print data and the like from a host computer (not shown) or the like, a RAM 44 for storing various kinds of data and the like, a ROM 45 for storing control routines and the like for processing various kinds of data, a controller 46 constituted by a CPU and the like, an oscillator 47, a drive signal generator 48 for generating a drive signal to be supplied to the recording head 1, and an internal interface 49 for transmitting to the print engine 42 recording data obtained by expanding the print data for every dot, the drive signal, and the like.

On the other hand, the print engine 42 is constituted by the recording head 1, a carriage mechanism 51 and a paper feeding mechanism 52. The recording head 1 comprises, with respect to each of the piezoelectric vibrators 2, a shift register 53 where recording data is set, a latch 54 for latching the recording data set in the shift register 53, a level shifter 55 serving as a voltage amplifier, a switcher 56 for controlling the supply of the drive signal to the corresponding piezoelectric vibrator 2.

The recording head 1 also comprises the memory 36. The memory 36 is a kind of ID information storage, in which the aforementioned ID information is stored. Then, the memory 36 is electrically connected to the controller 46. Thus, the controller 46 can read the ID information stored in the memory 36.

When the ID information is indicated on an indicator provided on the recording head 1 such as the adhesive seal 35 or the like, the ID information is transmitted to the controller 46 by an information reader 61 such as a scanner or a line sensor, or an information input device 62 such as a keyboard or a touch panel. For example, when the ID information is mechanically readable information such as bar codes, the ID information is read by use of the information reader 61 and transmitted to the controller 46. When the ID information is coded information formed out of alphabetical or numeric characters, the coded information is input through the information input device 62 and transmitted to the controller 46. Then, the controller 46 stores the received ID information into a nonvolatile information storage (e.g. an EEPROM, which is a kind of ID information storage, not shown).

The controller 46 controls each part of the printer on the basis of an operation program stored in the ROM 45. Then, the drive signal generator 48 generates a drive signal COM having a waveform established by the controller 46.

The drive signal COM generated from the drive signal generator 48 includes at least one driving pulse (pulse signal having a plurality of waveform elements required for ejecting an ink droplet) in each print cycle. The drive signal COM is generated repeatedly using the print cycle as unit. Then, the drive signal COM (driving pulse) is supplied selectively to the piezoelectric vibrator 2 through the switcher 56.

In addition, the controller 46 also serves as a waveform provider, which defines control factors of the waveform elements on the basis of the ID information (waveform setting information) stored in the memory 36. Thus, the waveform of the driving pulse is optimized in accordance with the natural vibration period Tc of the recording head 1 used.

Incidentally, the control factors are conditions for establishing the waveform elements as subjects of control, for example, including durations and potential differences. The control factors are not limited to the combination of durations and potential differences. For example, the control factors may be the combination of durations and potential gradients. In this embodiment, the durations of the waveform elements are set as the control factors, as will be described later.

Next, description will be made on specific examples of the drive signal COM generated by the drive signal generator 48 and the optimization of the drive signal COM (optimization of driving pulses) based on the ID information.

Figure 24:
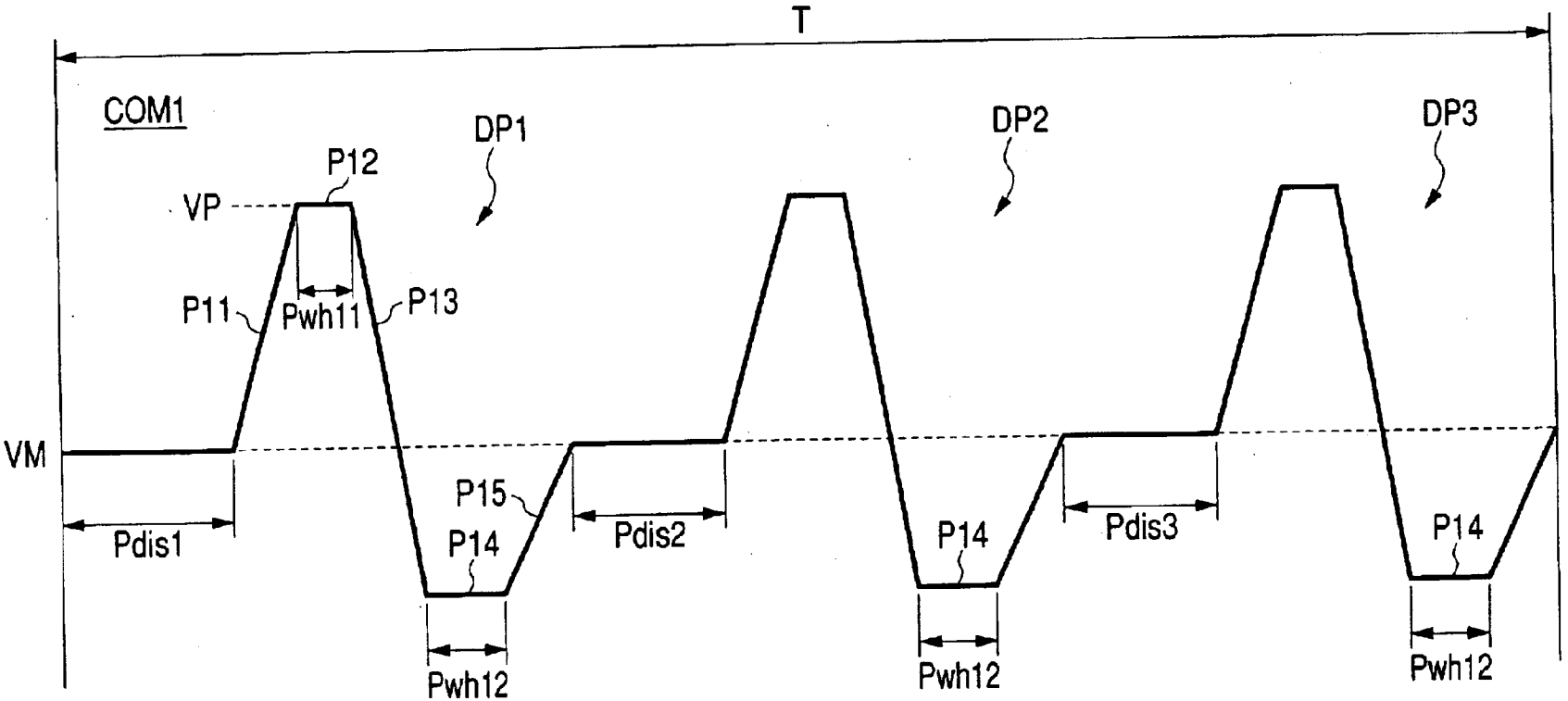
FIG. 24 is a diagram showing a drive signal generated from a drive signal generator in the ink jet printer, according to the first embodiment of the invention.

A first drive signal COM1 illustrated in FIG. 24 is a signal in which a plurality of normal dot driving pulses having one and the same waveform have been connected in series. That is, the first drive signal COM1 has a first normal dot driving pulse DP1 generated at the first stage of a print cycle T, a second normal dot driving pulse DP2 generated following the first normal dot driving pulse DP1, and a third normal dot driving pulse DP3 generated following the second normal dot driving pulse DP2. These normal dot driving pulses DP1 to DP3 are generated repeatedly for every print cycle T.

Each of the normal dot driving pulses DP1 to DP3 is a driving pulse capable of ejecting an ink droplet individually. Each normal dot driving pulse DP1-DP3 is formed out of an expansion element P11 for increasing the potential from intermediate potential VM to maximum potential VP in a fixed gradient gentle enough not to eject any ink droplet, an expansion holding element P12 for keeping the maximum potential VP for a predetermined time period, an ejection element P13 for decreasing the potential from the maximum potential VP to minimum potential VG in a steep gradient, a damping holding element P14 for keeping the minimum potential VG for a predetermined time period, and a damping expansion element P15 for increasing the potential from the minimum potential VG to the intermediate potential VM. Incidentally, the expansion element P11 to the damping expansion element P15 correspond to the waveform elements in each of the normal dot driving pulses DP1 to DP3.

Then, whenever each normal dot driving pulse DP1–DP3 is supplied to the piezoelectric vibrator 2, an ink droplet having an amount to be able to form a normal dot, for example, a volume of about 13 pL, is ejected from the nozzle orifice 13.

In this first drive signal COM1, only the second normal dot driving pulse DP2 is supplied to the piezoelectric vibrator 2 when dot pattern data is data of a small dot. When the dot pattern data is data of a middle dot, the first normal dot driving pulse DP1 and the third normal dot driving pulse DP3 are supplied to the piezoelectric vibrator 2. Further, when the dot pattern data is data of a large dot, all the normal dot driving pulses DP1 to DP3 are supplied to the piezoelectric vibrator 2.

Then, the controller 46 controls the drive signal generator 48 in accordance with the ID information (determined natural vibration period Tc) of the recording head 1, so as to define the control factors of the waveform elements engaging in suppression of the vibration of the meniscus M. In this embodiment, duration Pwh12 of the damping holding element P14 is defined while intervals Pdis1 to Pdis3 between adjacent ones of the normal dot driving pulses DP1 to DP3 are defined.

The duration Pwh12 of the damping holding element P14 defines the timing at which the supply of the damping expansion element P15 is started after the ink droplet ejection. That is, when the duration Pwh12 is set to be shorter than its designed value, the damping expansion element P15 is supplied at an earlier timing. On the contrary, when the duration Pwh12 is set to be longer than the designed value, the damping expansion element P15 is supplied at a later timing.

Then, when the natural vibration period Tc of the recording head 1 mounted is shorter than the standard natural vibration period Tcstd, the damping expansion element P15 is supplied at an earlier timing. On the contrary, when the natural vibration period Tc is longer than the standard natural vibration period Tcstd, the damping expansion element P15 is supplied at a later timing.

With such a configuration, the damping expansion element P15 can be supplied at a timing suitable to the recording head 1 so that the meniscus M can be restored from vibration effectively (rapidly).

Accordingly, when the determined natural vibration period Tc is equal to the standard natural vibration period Tcstd, the duration Pwh12 of the damping holding element P14 is also set to be equal to its designed value. When the determined natural vibration period Tc is shorter than the standard natural vibration period Tcstd, the duration Pwh12 is set to be shorter than the designed value. On the other hand, when the determined natural vibration period Tc is longer than the standard natural vibration period Tcstd, the duration Pwh12 is set to be longer than the designed value.

The duration Pwh12 may be set using table information. For example, table information indicating the relationship between the determined natural vibration period Tc and the duration Pwh12 is stored in the ROM 45 of the printer controller 41 or a nonvolatile information storage (e.g. EEPROM, which is a kind of ID information storage, not shown). The duration Pwh12 is acquired from the table information by the controller 46. That is, the controller 46 sets the duration Pwh12 on the basis of the table information and the ID information of the memory 36.

In this case, the duration Pwh12 can be finely adjusted in accordance with the determined natural vibration period Tc. For example, when the adjustable width of the duration Pwh12 is ±1 μs around its designed value (20 steps on the side shorter than the designed value at an interval of 0.05 μs and 20 steps on the side longer than the designed value at an interval of 0.05 μs). Accordingly, the duration Pwh12 optimal for the recording head 1 can be established with high accuracy.

In addition, in this embodiment, the duration of a waveform element (damping holding element P14) is used as the control factor. Accordingly, when a first correction time period varying in accordance with the ID information is added to the reference duration of the waveform element, the adjusted duration of the waveform element can be established. In this case, when a second correction time period varying in accordance with the environmental temperature under which the printer is used is added to the reference duration of the waveform element, the adjusted duration of the waveform element can be established more accurately.

For example, the controller 46 can establish the duration Pwh12 on the basis of formula shown in the following expressions (6) to (8).

$$Pwh12=BT+RT1+RT2 \quad (6)$$

$$RT1=a(Tc-Tcstd) \quad (7)$$

$$RT2=b(t-ta)/(tb-ta) \quad (8)$$

Incidentally, in the respective expressions, Pwh12 designates the duration of the damping holding element P14, BT designates the reference duration, RT1 designates the first correction time period, RT2 designates the second correction time period, Tc designates the determined natural vibration period, Tcstd designates the standard natural vibration period, "a" designates a first correction coefficient, "b" designates a second correction coefficient, "t" designates a measured temperature, ta designates an upper limit value of the temperature range, and tb designates a lower limit value of the temperature range.

In addition, the intervals Pdis1 to Pdis3 between adjacent ones of the normal dot driving pulses are changed in accordance with the duration Pwh12 of the damping holding element P14. This is because the recording cycle T is fixed so that there may occur an inconvenience if the duration Pwh12 of the damping holding element P14 is changed simply.

For example, when the duration Pwh12 is set to be shorter than its designed value, the interval Pdis1 between the termination end of the third normal dot driving pulse DP3 and the initial end of the first normal dot driving pulse DP1 in the next recording cycle is longer than any other interval Pdis2, Pdis3. This difference in interval results in the difference in the interval with which ink droplets are landed, causing color shading in the case of solid recording (painting) and so on. Accordingly, in this case, the intervals Pdis1 to Pdis3 are set to be longer correspondingly to the reduction of the duration Pwh12, so as to make the intervals between adjacent ones of the normal dot driving pulses identical.

On the other hand, when the duration Pwh12 is set to be longer than its designed value, the termination end of the third normal dot driving pulse DP3 traverses the termination end of the recording cycle T. In this case, the damping expansion element P15 of the third normal dot driving pulse DP3 is cut halfway. Accordingly, in this case, the intervals Pdis1 to Pdis3 are set to be shorter correspondingly to the elongation of the duration Pwh12 so as to make the intervals between adjacent ones of the normal dot driving pulses identical, while fitting the respective normal dot driving pulses DP1 to DP3 into the recording cycle T.

The duration Pwh11 of the expansion holding element P12 may be changed in accordance with the ID information of the recording head 1 by the controller 46. In this case, the state of the meniscus M at the supply timing of the ejection element P13 can be made identical, regardless of the difference of the natural vibration period Tc. As a result, the ejected ink droplet amount can be made identical and hence the image quality can be improved.

The intermediate potential VM (reference potential) of the first drive signal COM1 may be changed in accordance with the ID information of the recording head 1 by the controller 46. For example, it can be considered that the kinetic energy of the ink in the pressure chamber 14 in a recording head 1 whose natural vibration period Tc is shorter than the standard natural vibration period Tcstd is larger than the kinetic energy in a recording head 1 whose natural vibration period is equal to the standard natural vibration period Tcstd. On the contrary, it can be considered that the kinetic energy of the ink in the pressure chamber 14 in a recording head 1 whose natural vibration period Tc is longer than the standard natural vibration period Tcstd is smaller than the kinetic energy in a recording head 1 whose natural vibration period is equal to the standard natural vibration period Tcstd.

The intermediate potential VM defines the potential difference of the expansion element P11, that is, the expansion width of the pressure chamber 14. Accordingly, when the intermediate potential VM is set to be lower than its designed value, the expansion width of the pressure chamber 14 increases so that the kinetic energy given to the ink in the pressure chamber 14 can be increased correspondingly. On the contrary, when the intermediate potential VM is set to be higher than the designed value, the expansion width of the pressure chamber 14 is reduced so that the kinetic energy given to the ink in the pressure chamber 14 can be reduced correspondingly.

Accordingly, in the recording head 1 whose natural vibration period Tc is shorter than its designed value, the intermediate potential VM is set to be higher than its designed value. On the contrary, in the recording head 1 whose natural vibration period Tc is longer than its designed value, the intermediate potential VM is set to be lower than its designed value. Thus, the kinetic energy of the ink which might be scattered in accordance with the natural vibration period Tc can be made uniform so that the ejection characteristics of ink droplets can be made identical.

The first embodiment has described on the configuration in which a standard time interval (time interval t9, see FIG. 10) corresponding to a bottom point of a standard period variation curve is used as reference, and ejected ink amounts IwS and IwL and the ink amount ratio (IwS/IwL) are acquired by use of a first time interval shorter than the standard time interval by predetermined time and a second time interval longer than the standard time interval by the predetermined time. However, the invention is not limited to this configuration.

For example, one of the first and second time intervals may be set to supply the ejection element PS3 within an increasing time range where the ejected ink amount increases with the increase of the natural vibration period Tc, while the other of the first and second time intervals is set to supply the ejection element PS3 within a decreasing time range where the ejected ink amount decreases with the increase of the natural vibration period Tc.

Description will be made below on a second embodiment thus configured. Incidentally, the influence of the variation of the ejected ink amount caused by the characteristic difference of the vibrator unit 5 or the like can be ignored by use of the ink amount ratio. Therefore, the variation of the ejected ink amount caused by the characteristic difference of the vibrator unit 5 or the like will be not taken into consideration in the following description.

Figure 14:
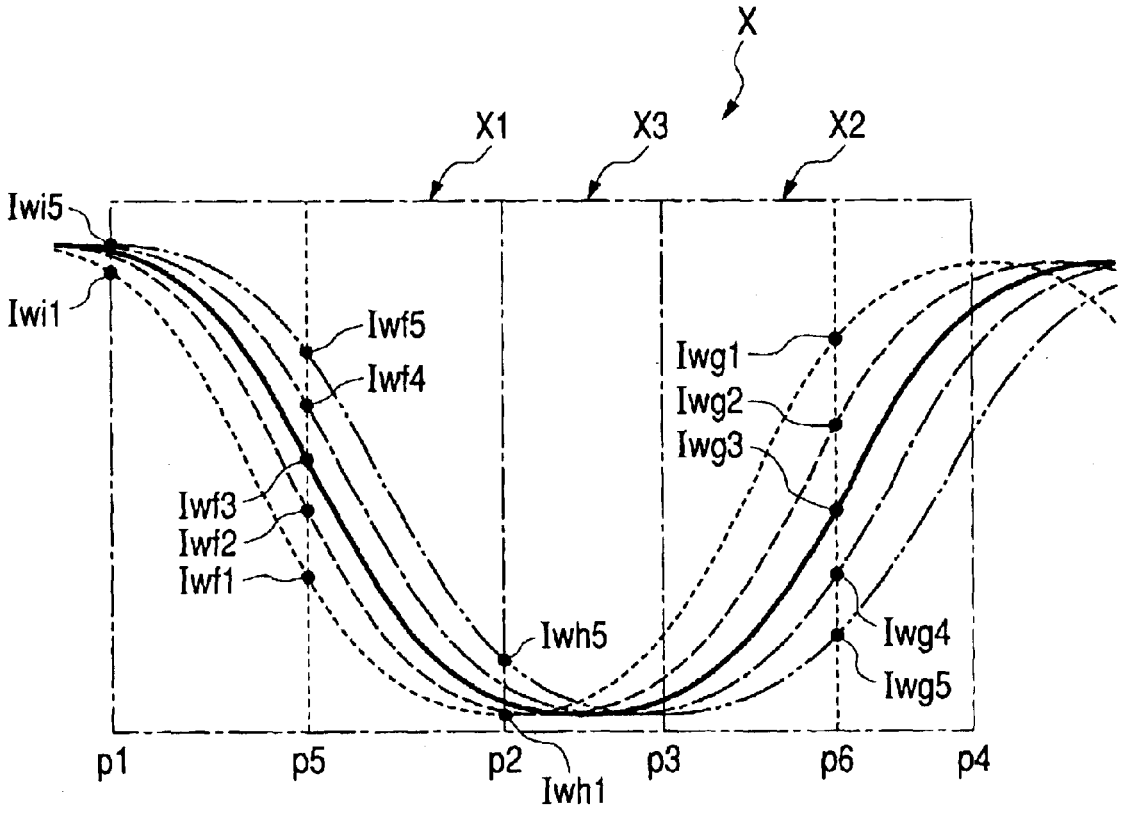
FIG. 14 is an enlarged view of a portion X in FIG. 7, for explaining a second embodiment of the invention.

FIG. 14 is a graph in which the area designated by the sign X in the ejected ink amount variation curves in FIG. 8 is enlarged. In this figure, the dotted line designates the minimum period variation curve, and the chain double-dashed line designates the maximum period variation curve. In addition, the solid line designates the standard period variation curve. Further, in this example, the broken line designates an ink amount variation curve of a recording head 1 having a middle natural vibration period Tc between that of the minimum period recording head and that of the standard period recording head (referred to as "first intermediate recording head 1" for the sake of convenience), while the chain line designates an ink amount variation curve of a recording head 1 having a middle natural vibration period Tc between that of the maximum period recording head and that of the standard period recording head (referred to as "second intermediate recording head 1" for the sake of convenience).

In addition, in FIG. 14, the first peak point in the maximum period variation curve is set as a timing p1, and the first bottom point in the minimum period variation curve is set as a timing p2. Then, the first bottom point in the maximum period variation curve is set as a timing p3, and the second peak point in the minimum period variation curve is set as a timing p4. In this example, the increasing time range corresponds to a time range X1 not earlier than the timing p1 and not later than the timing p2, while the decreasing time range corresponds to a time range X2 not earlier than the timing p3 and not later than the timing p4.

When ejected ink amounts Iwf1 to Iwf5 at a timing p5 belonging to the increasing time range are compared with one another, the following relation is established. That is, the ejected ink amount Iwf1 of the minimum period recording head whose natural vibration period Tc is the shortest is the smallest, the ejected ink amount Iwf2 of the first intermediate recording head 1 whose natural vibration period Tc is the second shortest is the second smallest, and the ejected ink amount Iwf3 of the standard period recording head is the third smallest. In addition, the ejected ink amount Iwf4 of the second intermediate recording head 1 whose natural vibration period Tc is the second longest is the second largest, and the ejected ink amount Iwf5 of the maximum period recording head whose natural vibration period Tc is the longest is the largest. Then, the same relationship among the ejected ink amounts Iwf1 to Iwf5 is established in the range of from the timing p1 to the timing p2. In other words, the ejected ink amount variation curves have no intersection in the range of from the timing p1 to the timing p2. Accordingly, in the range of from the timing p1 to the timing p2, the ejected ink amount increases with the increase of the natural vibration period Tc of the recording head 1 when the supply timing of the ejection element PS3 is fixed.

On the other hand, when ejected ink amounts Iwg1 to Iwg5 at the timing p6 belonging to the decreasing time range are compared with one another, the following relationship is established. That is, the ejected ink amount Iwg1 of the minimum period recording head whose natural vibration period Tc is the shortest is the largest, the ejected ink amount Iwg2 of the first intermediate recording head 1 whose natural vibration period Tc is the second shortest is the second largest, and the ejected ink amount Iwg3 of the standard period recording head is the third largest. In addition, the ejected ink amount Iwg4 of the second intermediate recording head 1 whose natural vibration period Tc is the second longest is the second smallest, and the ejected ink amount Iwg5 of the maximum period recording head whose natural vibration period Tc is the longest is the smallest. Then, the same relationship among the ejected ink amounts Iwg1 to Iwg5 is established in the range of from the timing p3 to the timing p4. That is, the ejected ink amount variation curves have no intersection in the range of from the timing p3 to the timing p4. Accordingly, in the range of from the timing p3 to the timing p4, the ejected ink amount decreases with the increase of the natural vibration period Tc of the recording head 1 when the supply timing of the ejection element PS3 is fixed.

Then, when the supply timing (first supply timing) of the ejection element PS3 in the first evaluation pulse TP1 is set in the increasing time range and the supply timing (second supply timing) of the ejection element PS3 in the second evaluation pulse TP2 is set in the decreasing time range, in other words, when setting is done so that bottom ranges at the same cycle in the ejected ink amount variation curves exist between the first supply timing and the second supply timing, the natural vibration period Tc of the recording head 1 can be acquired from the calculated ink amount ratio with high accuracy.

That is, the ink amount ratio has the first ink amount IwS of the first evaluation pulse TP1 as its numerator and the second ink amount IwL of the second evaluation pulse TP2 as its denominator. Therefore, as the natural vibration period Tc increases, the first ink amount IwS increases while the second ink amount IwL decreases. On the contrary, as the natural vibration period Tc decreases, the first ink amount IwS decreases while the second ink amount IwL increases.

As a result, the variation width of the ink amount ratio relative to the variation width of the natural vibration period Tc can be made larger than that in the comparative example which will be described later. Thus, the natural vibration period Tc in the recording head 1 can be acquired from the ink amount ratio with high accuracy.

Figure 15:
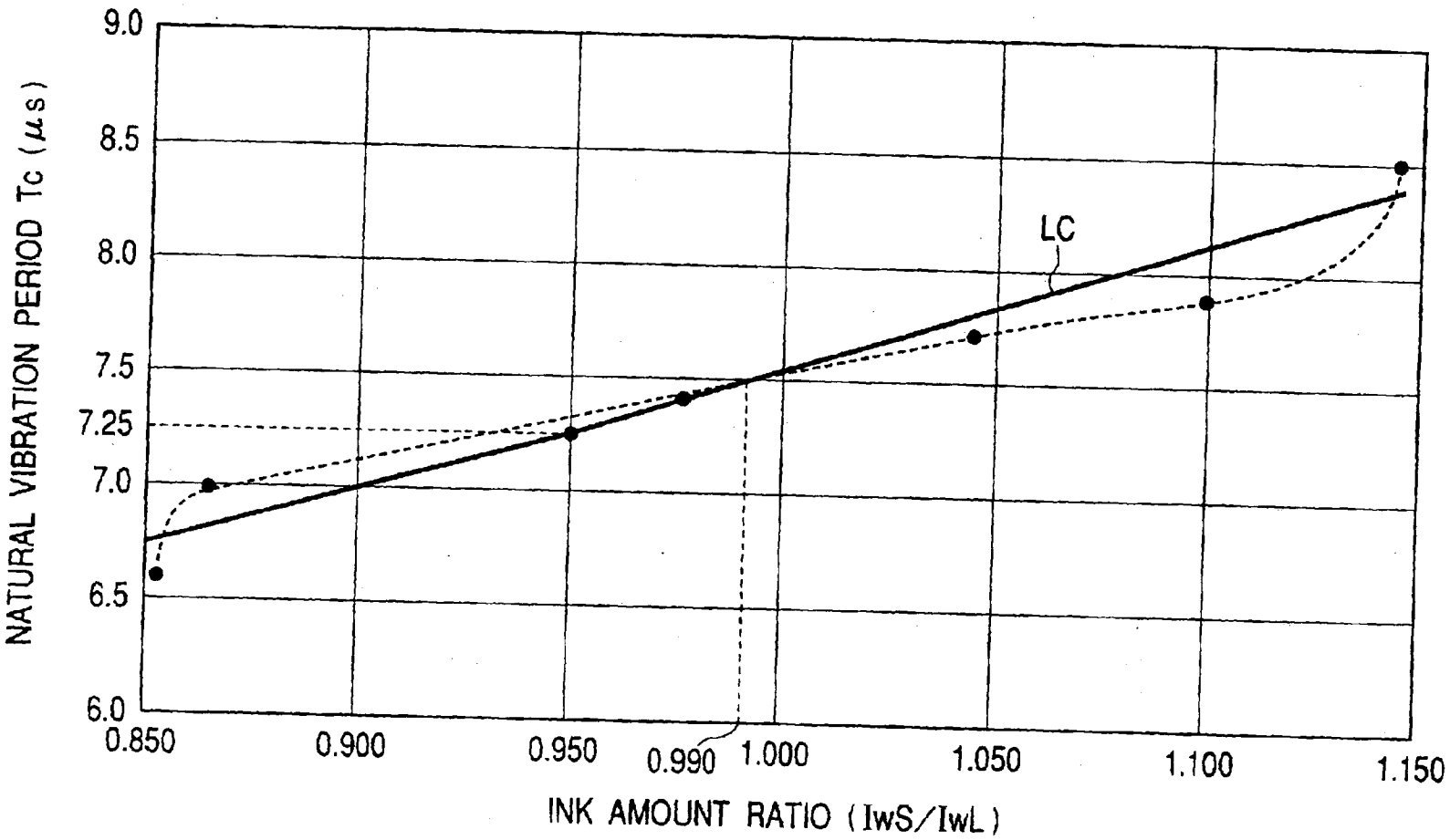
FIG. 15 is a graph showing the relationship between the natural vibration period and the ink amount ratio concerning a plurality of recording heads, showing an example in which the correlation therebetween is approximated by a linear expression.

For example, the timing p2 is set for the supply timing of the ejection element PS3 in the first evaluation pulse TP1, and the timing p3 is set for the supply timing of the ejection element PS3 in the second evaluation pulse TP2. In this case, as shown in FIG. 15, the variation width of the natural vibration period Tc ranges from about 6.6 μs to about 8.5 μs while the variation width of the ink amount ratio ranges from about 0.850 to about 1.150. In this range, as shown by the solid line in FIG. 15, the correlation between the natural vibration period Tc and the ink amount ratio can be expressed by a linear expression (calibration line LC) using the ink amount ratio as a variable. In such a manner, the variation width of the ink amount ratio relative to the variation width of the natural vibration period Tc is sufficiently large so that the natural vibration period Tc in the recording head 1 can be acquired from the ink amount ratio with high accuracy.

Incidentally, the designed value of the natural vibration period Tc in the recording head 1 used in this example is 7.5 μs.

Each of the supply timings p2 and p3 of the ejection element PS3 for the evaluation pulses TP1 and TP2 used for calculating the correlation in FIG. 15 was close to the bottom point of the ejected ink amount variation curve. Then, each of the supply timings p2 and p3 is a timing having a relatively small variation width of the ejected ink amount relative to the variation width of the natural vibration period Tc within the increasing time range or the decreasing time range.

For example, when the supply timing p2 is compared with the supply timing p5, the ejected ink amount varies from Iwf1 to Iwf5 in the supply timing p5 while the natural vibration period Tc varies from the minimum natural vibration period Tcmin to the maximum natural vibration period Tcmax. On the other hand, the ejected ink amount varies from Iwh1 to Iwh5 in the supply timing p2 while the natural vibration period Tc varies from the minimum natural vibration period Tcmin to the maximum natural vibration period Tcmax. Then, as is apparent from the figure, the difference between the ejected ink amounts Iwf5 and Iwf1 is larger than the difference between the ejected ink amounts Iwh5 and Iwh1.

In addition, in the supply timing p1, the ejected ink amount varies from Iwi1 to Iwi5 while the natural vibration period Tc varies from the minimum natural vibration period Tcmin to the maximum natural vibration period Tcmax. Then, the variation width is smaller than the difference between the ejected ink amounts Iwf1 and Iwf5 in the supply timing p5.

The aforementioned fact means that the supply timing of the ejection element PS3 has optimum values in the increasing time range and the decreasing time range respectively. Description will be made below on the optimum values.

Figure 16:
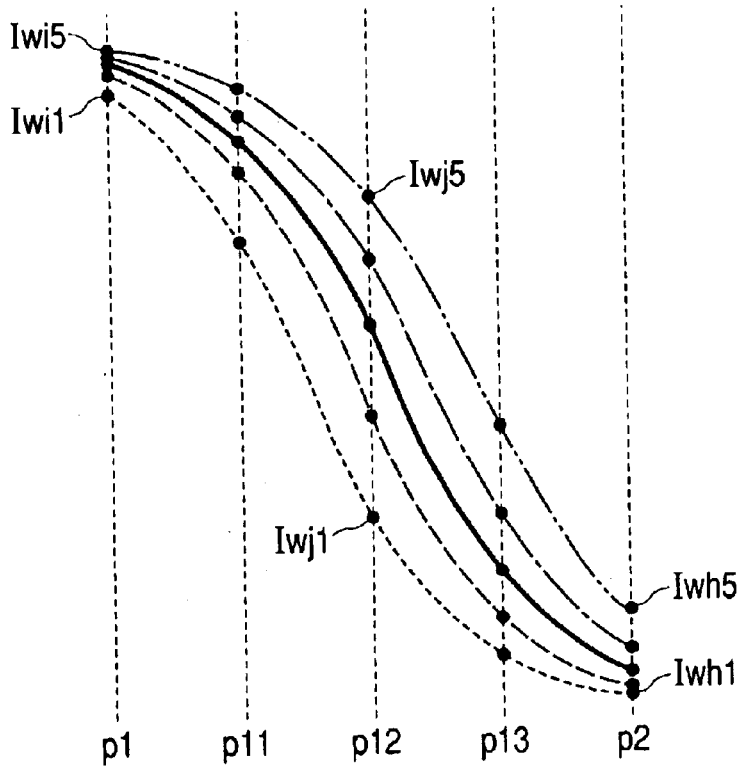
FIG. 16 is an enlarged graph for explaining the difference in ink amount due to the difference in natural vibration period in the range X1 shown in FIG. 14.
Figure 17:
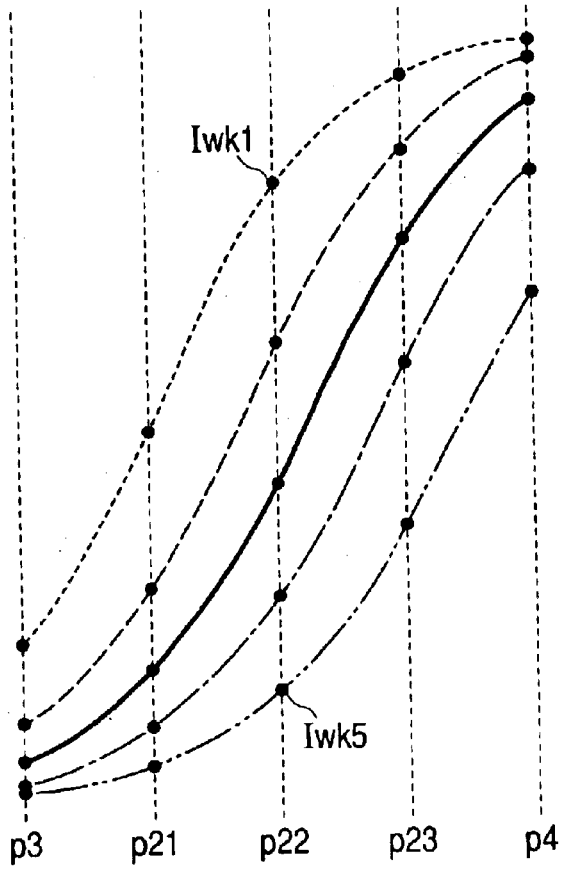
FIG. 17 is an enlarged graph for explaining the difference in ink amount due to the difference in natural vibration period in the range X2 shown in FIG. 14.

FIG. 16 is a graph showing the variation of the ejected ink amount in the increasing time range (not earlier than p1 and not later than p2) for each of the five kinds of recording heads 1 different in natural vibration period Tc. FIG. 17 is a graph showing the variation of the ejected ink amount in the decreasing time range (not earlier than p3 and not later than p4) for each of the five kinds of recording heads 1 different in natural vibration period Tc. In FIG. 16, the timing p12 is a timing at which the variation of the ejected ink amount per unit time is maximal in the standard period variation curve (solid line). Then, the timing p11 is a timing lying midway between the timing p1 and the timing p12, and the timing p13 is a timing lying midway between the timing p12 and the timing p2. On the other hand, in FIG. 17, the timing p22 is a timing at which the variation of the ejected ink amount per unit time is maximal in the standard period variation curve (solid line). Then, the timing p21 is a timing lying midway between the timing p3 and the timing p22, and the timing p23 is a timing lying midway between the timing p22 and the timing p4.

As is apparent from these figures, each ink amount variation curve has a largest variation width (Iwj5–Iwj1) of the ejected ink amount at the timing p12 in the increasing time range. Similarly, in the decreasing time range, each ink amount variation curve has a largest variation width (Iwk1–Iwk5) of the ejected ink amount at the timing p22.

Accordingly, when the supply timing of the ejection element PS3 in the increasing time range is set at the timing p12, the variation width of the ejected ink amount caused by the variation of the natural vibration period Tc can be increased to a maximum. On the other hand, in the decreasing time range, when the supply timing of the ejection element PS3 is set at the timing p22, the variation width of the ejected ink amount caused by the variation of the natural vibration period Tc can be increased to a maximum.

As a result, the variation width of the ink amount ratio relative to the variation width of the natural vibration period Tc can be made as large as possible. Thus, the natural vibration period Tc in the recording head 1 can be acquired from the ink amount ratio with higher accuracy.

Incidentally, in this case, when the first and second evaluation pulses TP1 and TP2 are set, it is necessary to acquire the standard period variation curve. The standard period variation curve can be measured as described above. That is, a plurality of evaluation pulses TP changed in time interval from the excitation element PS1 to the ejection element PS3 are used as measuring signals, and the measuring signals are supplied to a standard period recording head.

Next, as a comparative example, description will be made on the case where a time range out of the increasing time range and out of the decreasing time range is used. Here, description will be made with a range X3 sandwiched between the increasing time range X1 and the decreasing time range X2, that is, a range (hereinafter, referred to as "bottom range") later than the timing p2 and earlier than the timing p3, by way of example.

Figure 18:
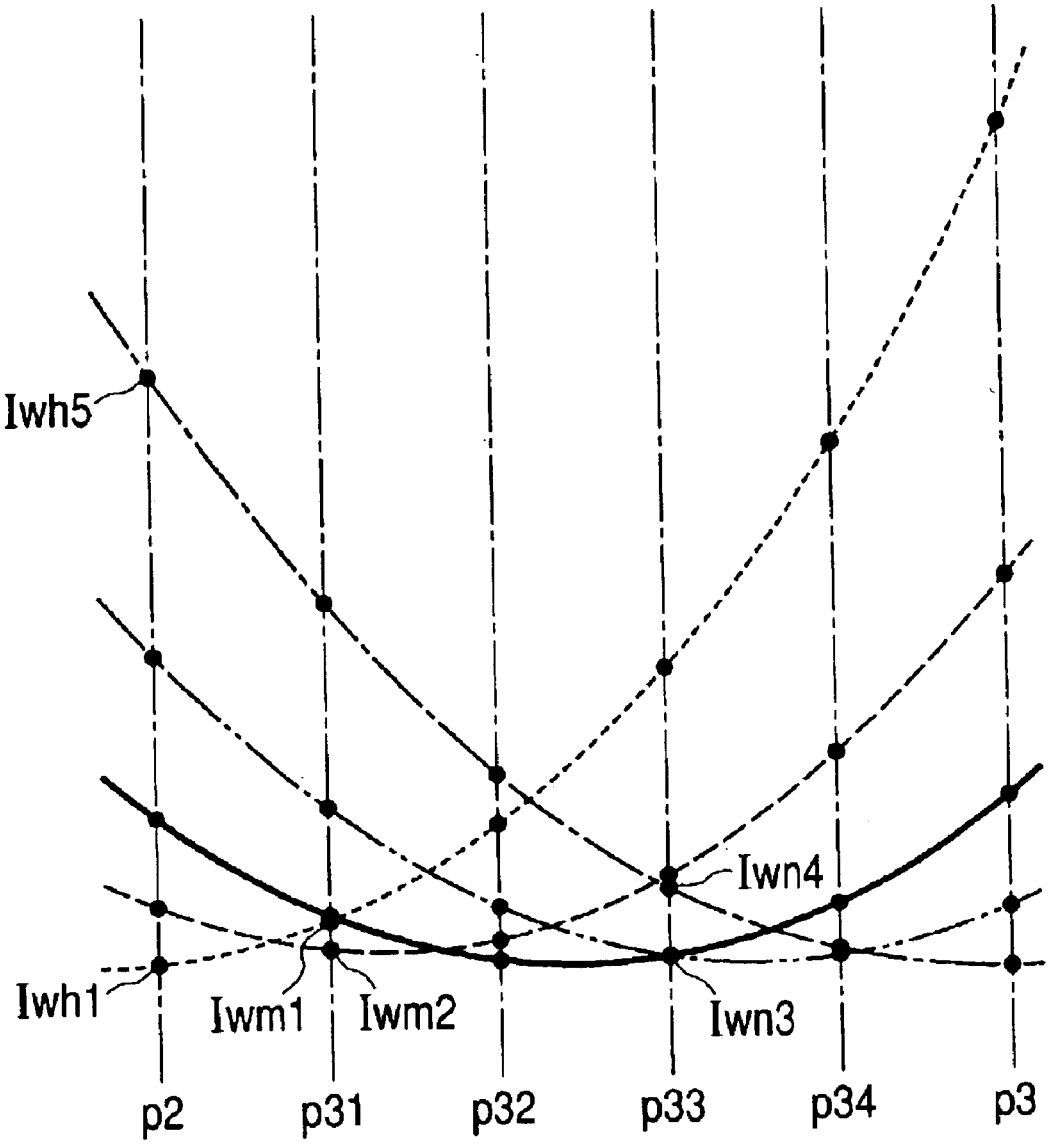
FIG. 18 is an enlarged graph for explaining a comparative example, showing the difference in ink amount for each natural vibration period in the range X3 shown in FIG. 14.

FIG. 18 is a graph showing the variation of the ejected ink amount in this bottom range for each of the five kinds of recording heads 1 different in natural vibration period Tc. Then, as shown in FIG. 18, the bottom range has a timing at which there is no one-to-one correspondence between the ejected ink amount and the natural vibration period Tc. For example, when a timing p31 is set as the supply timing of the ejection element PS3, the standard period recording head and the minimum period recording head have substantially the same ink amount Iwm1. Further, the ejected ink amount Iwm2 of the first intermediate recording head 1 is smaller than the ejected ink amount Iwh1. This means that there occurs a reversal phenomenon in a range of from the minimum natural vibration period Tcmin to the standard natural vibration period Tcstd, in which phenomenon the ejected ink amount once decreases with the increase of the natural vibration period Tc and then increases. Accordingly, when the recording head 1 as a subject of measurement has a natural vibration period Tc in this range, there are two natural vibration periods Tc for one measured ink amount.

Similarly, when the supply timing of the ejection element PS3 is set at a timing p33 a litter later than the timing p31, the standard period recording head and the second intermediate recording head 1 have substantially the same ink amount Iwn3, that is the smallest. Further, the maximum period recording head and the first intermediate recording head 1 have substantially the same ink amount Iwn4. Accordingly, there occurs a reversal phenomenon as to the ejected ink amount in a wide range of from the natural vibration period Tc of the first intermediate recording head 1 to the maximum natural vibration period Tcmax of the maximum period recording head, and there are two natural vibration periods Tc for one ink amount.

Accordingly, it is not preferable that the supply timing of the ejection element PS3 is set in the bottom range, from the point of view of improving the measuring accuracy, because both the two evaluation pulses TP1 and TP2 use the timing in which there are two natural vibration periods Tc for one ink amount. Further, this range lies near the bottom point of the ejected ink amount variation curve. Thus, the degree of variation of the ejected ink amount relative to the degree of variation of the natural vibration period Tc is small. Also from this point, such setting is not preferable so that the measuring accuracy is difficult to be improved.

As a result, when the supply timing of the ejection element PS3 in each of the two evaluation pulses TP1 and TP2 is set in the bottom range, the variation width of the ink amount ratio relative to the variation width of the natural vibration period Tc becomes smaller than that in the aforementioned embodiment. Thus, the measuring accuracy of the natural vibration period Tc is lowered.

Figure 19:
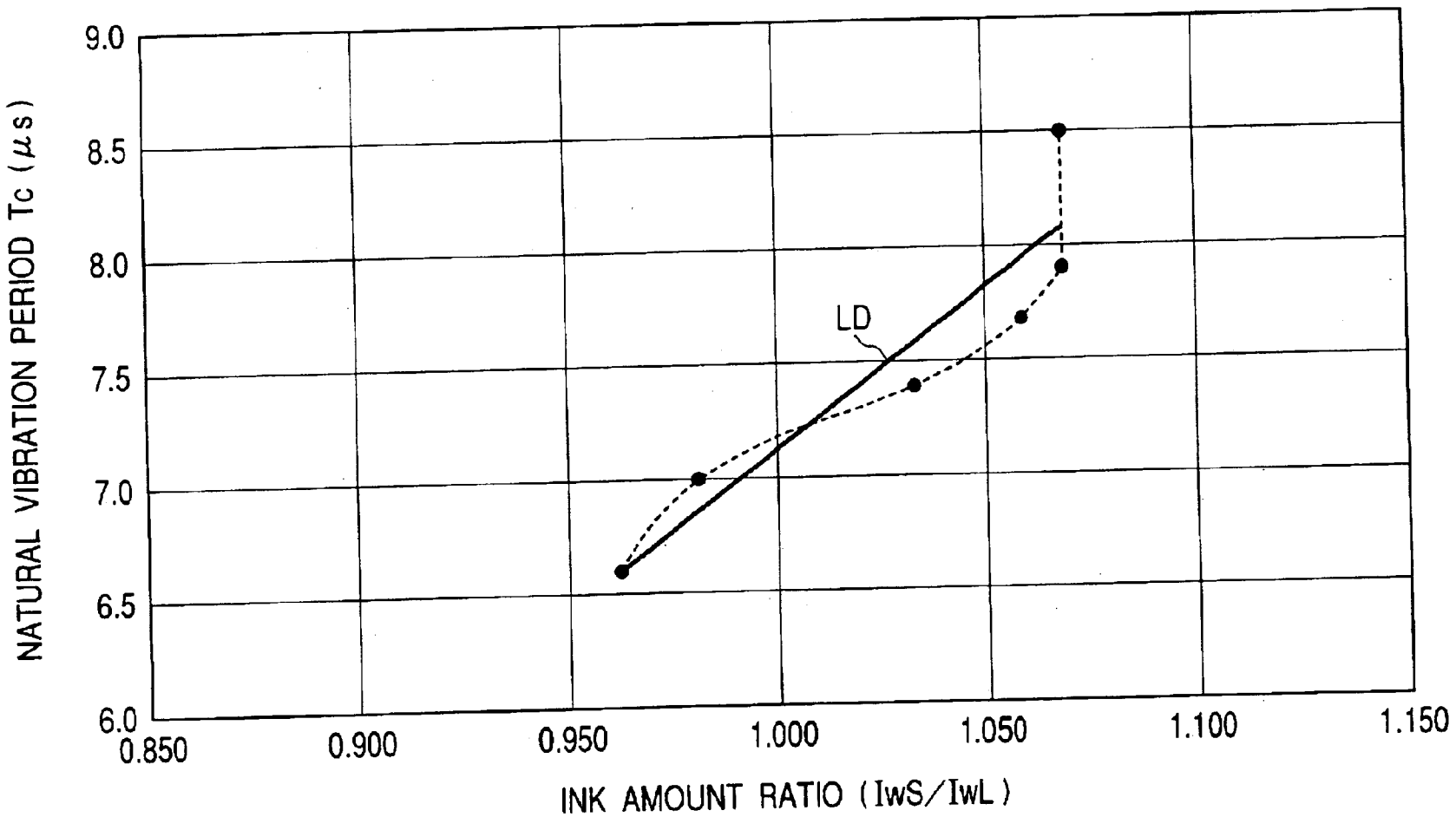
FIG. 19 is a graph showing the relationship between the natural vibration period and the ink amount ratio in the comparative example.

For example, when the supply timing of the ejection element PS3 in the first evaluation pulse TP1 is set at the timing p32 and the supply timing of the ejection element PS3 in the second evaluation pulse TP2 is set at the timing p33, the variation width of the ink amount ratio is in a range of about 0.960–1.070 while the variation width of the natural vibration period Tc is in a range of about 6.6–8.5 μs, as shown in the linear expression expressed by the calibration line LD in FIG. 19.

Compared with the example of FIG. 15, that is, the embodiment in which the increasing time range and the decreasing time range are used, the variation width of the natural vibration period Tc is about 6.6–8.5 μs in either case. However, the variation width of the ink amount ratio varies in a range of from about 0.850 to 1.150 in the example of FIG. 13, while it varies only in a range of from about 0.960 to 1.070 in the example of FIG. 19. Accordingly, it is proved that, by using the increasing time range and the decreasing time range, the natural vibration period Tc in the recording head 1 as a subject of measurement can be measured with higher accuracy.

Then, in the ink amount ratio calculating step, the ink amount ratio is obtained from the first and second ejected ink amounts IwS and IwL measured in the measuring step, as described above. In the natural vibration period determining step, the obtained ink amount ratio is substituted into the correlation between the natural vibration period Tc and the ink amount ratio, so as to determine the natural vibration period Tc in the recording head 1. Further, in the information providing step, the information of the determined natural vibration period Tc is provided for the recording head 1 through an information providing medium.

Description will be made on the example of FIG. 15. The natural vibration period Tc is judged to be 7.25 μs when the ink amount ratio in the recording head 1 is 0.950. The natural vibration period Tc is judged to be 7.5 μs when the ink amount ratio is 0.990.

As described above, also in this second embodiment, the ejected ink amounts are measured by use of two kinds of evaluation pulses TP1 and TP2 different in duration Pwh1 of the first holding element PS2, so that the natural vibration period Tc in the recording head 1 can be measured. Then, this measurement of the ejected ink amounts is simple and easy, and easy to assist automation. Thus, the method is suitable for mass production.

Further, in this embodiment, as for the supply timing of the ejection element PS3, the first evaluation pulse TP1 is set in the increasing time range while the second evaluation pulse TP2 is set in the decreasing time range. Thus, the natural vibration period Tc concerning the recording head 1 as a subject of measurement can be measured with high accuracy.

The combination of the increasing time range and the decreasing time range is not limited to the combination shown in the aforementioned embodiment. For example, the increasing time range may be set to be a range of from a second peak point in the maximum period variation curve to a second bottom point in the minimum period variation curve, as designated by the sign Y in FIG. 8. In this case, the supply timing of the ejection element PS3 in the first evaluation pulse TP1 is set in the decreasing time range while the supply timing of the ejection element PS3 in the second evaluation pulse TP2 is set in the increasing time range. Then, also in such a configuration, operation and effect similar to those in the aforementioned embodiment can be achieved.

Incidentally, it is preferable that the combination of the increasing time range and the decreasing time range is made of time ranges adjacent to each other. The reason is as follows. That is, when the increasing time range and the decreasing time range forming the combination are two or more cycles distant from each other in the direction of the temporal axis, the difference (variation width) between the minimum natural vibration period Tcmin and the maximum natural vibration period Tcmax becomes too large in the later time range while the variation width of the ejected ink amount also becomes too small due to attenuation. Thus, there is a probability that the measuring accuracy of the natural vibration period Tc is lowered.

In the above embodiments, the calibration line (linear expression) for calculating the ink amount ratio (IwS/IwL) was made up of one kind of first evaluation pulse TP1 and one kind of second evaluation pulse TP2. Therefore, when the natural vibration period Tc of the recording head 1 as a subject of measurement is largely deviated from its designed value, the accuracy of the determined natural vibration period Tc is lowered. This is because the calibration line has an optimum measuring range. Such a recording head 1 is usually dealt with as a defective product. However, in order to improve the productivity, it is demanded that even the natural vibration period Tc of such a recording head 1 is measured accurately so as to mount the recording head 1 on a printer.

In this case, when the ink amount ratio acquired in the ink amount ratio calculating step is judged to be out of a criterion range, at least one of the first and second evaluation pulses is reset so that the measuring range using the calibration line can be changed. It is therefore possible to mount the printer even with a recording head 1 whose natural vibration period Tc is largely deviated from its designed value. Description will be made below on a third embodiment thus configured.

Figure 20:
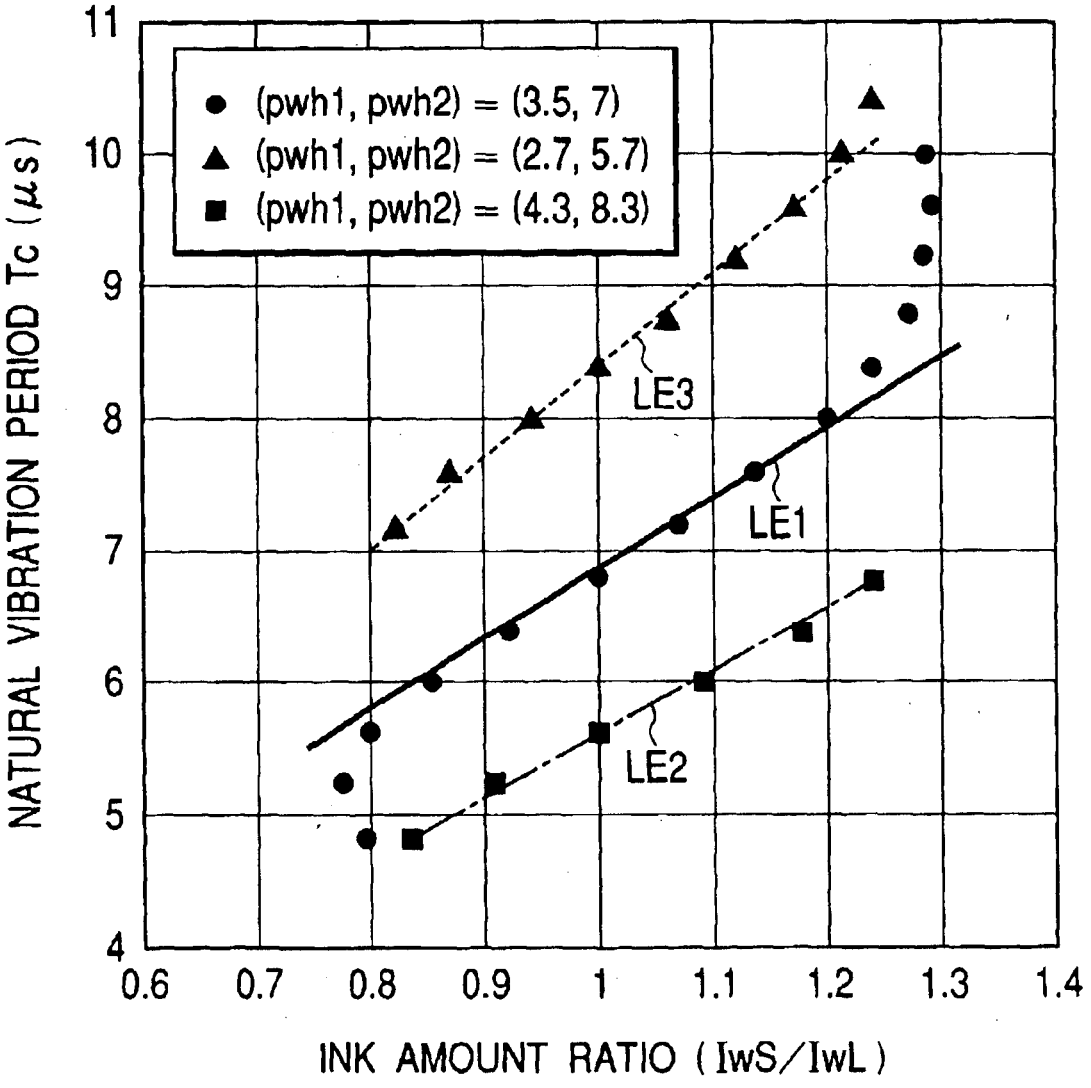
FIG. 20 is a graph showing the correlation between the natural vibration period and the ink amount ratio is approximated by three kinds of linear expressions, for explaining a third embodiment of the invention.

In this embodiment, as shown in FIG. 20, the correlation between the natural vibration period Tc and the ink amount ratio is expressed by three kinds of linear expressions corresponding to calibration lines LE1 to LE3 respectively.

Specifically, the correlation between the natural vibration period Tc and the ink amount ratio is expressed by a linear expression for the standard natural vibration period Tc (referred to as "a first linear expression LE1" for the sake of convenience), a linear expression for a natural vibration period Tc shorter than the standard natural vibration period Tc (referred to as "a second linear expression LE2" for the sake of convenience), and a linear expression for a natural vibration period Tc longer than the standard natural vibration period Tc (referred to as "a third linear expression LE3" for the sake of convenience).

The first linear expression LE1 expresses the correlation used when the ink amount ratio acquired in the ink amount ratio calculating step is in the criterion range. The second linear expression LE2 expresses the correlation used when the ink amount ratio acquired in the ink amount ratio calculating step is small to be out of the criterion range. In addition, the third linear expression LE3 expresses the correlation used when the ink amount ratio acquired in the ink amount ratio calculating step is large to be out of the criterion range.

According to this embodiment, as for the first linear expression LE1, the time interval Pwh1 (first time interval) of the first evaluation pulse TP1 is set at 3.5 μs, and the time interval Pwh1 (second time interval) of the second evaluation pulse TP2 is set at 7 μs. The evaluation pulses TP1 and TP2 are supplied to a plurality of recording heads 1 different in natural vibration period Tc, so as to obtain ejected ink amounts (ink amount ratio). The first linear expression LE1 is established on the basis of the obtained ejected ink amounts (ink amount ratio).

Then, as for the second linear expression LE2, the time interval Pwh1 (first time interval) of the first evaluation pulse TP1 is set at 2.7 μs, and the time interval Pwh1 (second time interval) of the second evaluation pulse TP2 is set at 5.7 μs. The evaluation pulses TP1 and TP2 are supplied to a plurality of recording heads 1 different in natural vibration period Tc, so as to obtain ejected ink amounts (ink amount ratio). The second linear expression LE2 is established on the basis of the obtained ejected ink amounts (ink amount ratio).

Similarly, as for the third linear expression LE3, the time interval Pwh1 (first time interval) of the first evaluation pulse TP1 is set at 4.3 μs, and the time interval Pwh1 (second time interval) of the second evaluation pulse TP2 is set at 8.3 μs. The evaluation pulses TP1 and TP2 are supplied to a plurality of recording heads 1 different in natural vibration period Tc, so as to obtain ejected ink amounts (ink amount ratio). The third linear expression LE3 is established on the basis of the obtained ejected ink amounts (ink amount ratio).

Incidentally, the standard natural vibration period Tcstd (designed value of the natural vibration period Tc) is 6.8 μs in this embodiment.

Description will be made below on a measuring step in this embodiment. In this measuring step, first, the evaluation pulses TP1 and TP2 (first time interval: 3.5 μs, and second time interval: 7 μs) used for calculating the first linear expression LE1 are supplied to the piezoelectric vibrators 2 respectively so that a predetermined number of ink droplets are ejected from the nozzle orifices 13. Then, the ink droplets are collected and the weight thereof is measured by the electronic balance 32 so as to obtain a first ink amount IwS and a second ink amount IwL as reference.

When the first and second ejected ink amounts IwS and IwL as reference have been measured, the controller 33 makes an operation to acquire an ink amount ratio (IwS/IwL) from the first and second ejected ink amounts IwS and IwL acquired from the electronic balance 32.

When the ink amount ratio has been acquired, the controller 33 judges whether the obtained ink amount ratio is in a criterion range or out of the criterion range.

In this embodiment, the criterion range is 0.9 to 1.1. Therefore, when the acquired ink amount ratio is in the range not smaller than 0.9 and not larger than 1.1, the controller 33 concludes that the acquired ink amount ratio is in the criterion range. On the contrary, when the acquired ink amount ratio is smaller than 0.9, the controller 33 concludes that the ink amount ratio is small to be out of the criterion range. Similarly, when the acquired ink amount ratio is larger than 1.1, the controller 33 concludes that the ink amount ratio is large to be out of the criterion range.

Here, when it has been concluded that the ink amount ratio is in the criterion range, the controller 33 determines the natural vibration period Tc of the recording head 1 as a subject of measurement by the first linear expression LE1.

In this case, the natural vibration period Tc is determined in the same procedure as that in the aforementioned embodiments. That is, the controller 33 substitutes the acquired ink amount ratio into the first linear expression LE1 so as to determine the natural vibration period Tc.

On the other hand, when it has been concluded that the ink amount ratio is small to be out of the criterion range, the controller 33 resets both the first evaluation pulse TP and the second evaluation pulse TP. Specifically, they are set as the evaluation pulses TP1 and TP2 (first time interval: 2.7 μs, and second time interval: 5.7 μs) used for calculating the second linear expression LE2.

When the evaluation pulses TP have been reset, the controller 33 supplies the updated reset evaluation pulses TP1 and TP2 to the piezoelectric vibrators 2. Then, the electronic balance 32 measures updated first and second ejected ink amounts IwS and IwL.

Incidentally, the specific operation in the ejected ink amount remeasuring step is similar to that in the ink amount ratio calculating step, and the description thereof will be therefore omitted.

When the updated first and second ejected ink amounts IwS and IwL have been measured, the controller 33 reacquires the ink amount ratio (IwS/IwL) based on these first and second ejected ink amounts IwS and IwL.

When the ink amount ratio has been reacquired, the controller 33 determines the natural vibration period Tc of the recording head 1 as a subject of measurement by the second linear expression LE2.

Also in this case, the natural vibration period Tc is determined in the same procedure as in the aforementioned embodiments. That is, the controller 33 substitutes the reacquired ink amount ratio into the second linear expression LE2 so as to determine the natural vibration period Tc.

Also when it has been concluded that the ink amount ratio is large to be out of the criterion range, the natural vibration period Tc is determined in a similar procedure.

Description will be made briefly. First, in the evaluation pulse resetting step, the controller 33 sets the time interval Pwh1 (first time interval) of the first evaluation pulse TP1 at 4.3 μs, and sets the time interval Pwh1 (second time interval) of the second evaluation pulse TP2 at 8.3 μs. Next, the process advances to the ejected ink amount remeasuring step, in which updated first and second ejected ink amounts IwS and IwL are measured by the controller 33 and the electronic balance 32. Then, the process advances to the ink amount ratio recalculating step, in which the ink amount ratio is reacquired from the updated first and second ejected ink amounts IwS and IwL by the controller 33. Lastly, the process advances to the natural vibration period determining step, in which the controller 33 determines the natural vibration period To of the recording head 1 as a subject of measurement from the acquired ink amount ratio and the third linear expression LE3.

In the configuration of this embodiment, an ink amount ratio is acquired by evaluation pulses TP1 and TP2 using a designed value of the natural vibration period Tc as reference. When the ink amount ratio is out of a criterion range (allowable range), that is, when the natural vibration period Tc of the recording head 1 as a subject of measurement is largely deviated from its designed value, an ink amount ratio is reacquired by evaluation pulses TP1 and TP2 suitable to that natural vibration period Tc. Then, the reacquired ink amount ratio is substituted into a corresponding linear expression (second linear expression LE2 or third linear expression LE3) so as to determine the natural vibration period Tc. Thus, even in the recording head 1 whose natural vibration period Tc is largely deviated from its designed value, the natural vibration period Tc can be measured with high accuracy.

Incidentally, in this embodiment, when it has been concluded that the ink amount ratio is out of the criterion range, both the first evaluation pulse TP and the second evaluation pulse TP are reset. However, the invention is not limited to such a configuration. For example, when it has been concluded that the ink amount ratio is out of the criterion range, either the first evaluation pulse TP or the second evaluation pulse TP may be reset.

For example, when it has been concluded that the ink amount ratio acquired by the reference evaluation pulses TP1 and TP2 is small to be out of the criterion range, the controller 33 resets the first evaluation pulse TP1 having a shorter time interval Pwh1 in the evaluation pulse resetting step. That is, the controller 33 sets the first time interval of the first evaluation pulse TP1 to be shorter than the standard (to be 2.7 μs in the aforementioned example).

On the contrary, when it has been concluded that the ink amount ratio acquired by the reference evaluation pulses TP1 and TP2 is large to be out of the criterion range, the controller 33 resets the second evaluation pulse TP2 having a longer time interval Pwh1 in the evaluation pulse resetting step. That is, the controller 33 sets the second time interval of the second evaluation pulse TP2 to be longer than the standard (to be 8.3 μs in the aforementioned example).

Next, in the ejected ink amount remeasuring step, the controller 33 and the electronic balance 32 measures an ink amount using the reset evaluation pulse TP. In addition, in the ink amount ratio recalculating step, the ink amount ratio is reacquired using the ejected ink amount obtained by the reset evaluation pulse TP and the ejected ink amount obtained by the evaluation pulse TP which has not been reset.

When the ink amount ratio has been reacquired, the natural vibration period Tc is determined in the same procedure as in the aforementioned embodiment (natural vibration period determining step).

Incidentally, in this case, the second linear expression LE2 is made up of the evaluation pulse TP1 having a first time interval of 2.7 μs and the evaluation pulse TP2 having a second time interval of 7 μs. On the other hand, the third linear expression LE3 is made up of the evaluation pulse TP1 having a first time interval of 3.5 μs and the evaluation pulse TP2 having a second time interval of 8.3 μs.

Then, also in the configuration of this embodiment, even in the recording head 1 whose natural vibration period Tc is largely deviated from its designed value, the natural vibration period Tc can be measured with high accuracy in the same manner as in the aforementioned embodiment.

The aforementioned configuration is also applicable to an embodiment in which the time intervals Pwh1 of the evaluation pulses TP1 and TP2 are defined by differences from the standard time interval (time interval t9) respectively as in the first embodiment.

In this case, the controller 33 uses the ink amount ratio (IwS/IwL) acquired in the ink amount ratio calculating step as information indicating a temporary standard vibration period Tcstd, so as to reset the standard time interval. Then, both the first evaluation pulse TP and the second evaluation pulse TP are reset using the reset standard time interval as reference.

Figure 21:
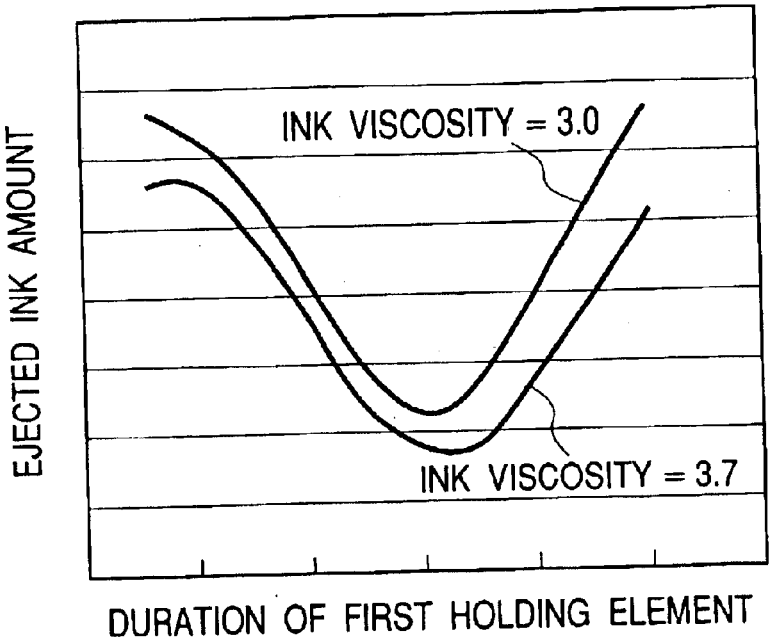
FIG. 21 is a graph showing the relationship between the duration of the first holding element and the ejected ink amount, when the temperature of measuring environment (ink viscosity) is changed, for explaining a fourth embodiment of the invention.

However, the correlation between the duration Pwh1 and the ink weight (ink amount) varies depending on the environmental temperature. It can be considered that this is because the viscosity of ink varies in accordance with the environmental temperature. That is, as illustrated in FIG. 21, it has been confirmed that the higher the viscosity of ink is, the smaller the amount of ejected ink droplets is. Therefore, in consideration of the case where the natural vibration period Tc is measured in the environment where the measuring temperature may change, it is preferable that the information of the natural vibration period Tc can be corrected in accordance with the temperature of the measuring environment. There will be described a fourth embodiment of the invention thus configured.

Figure 3:
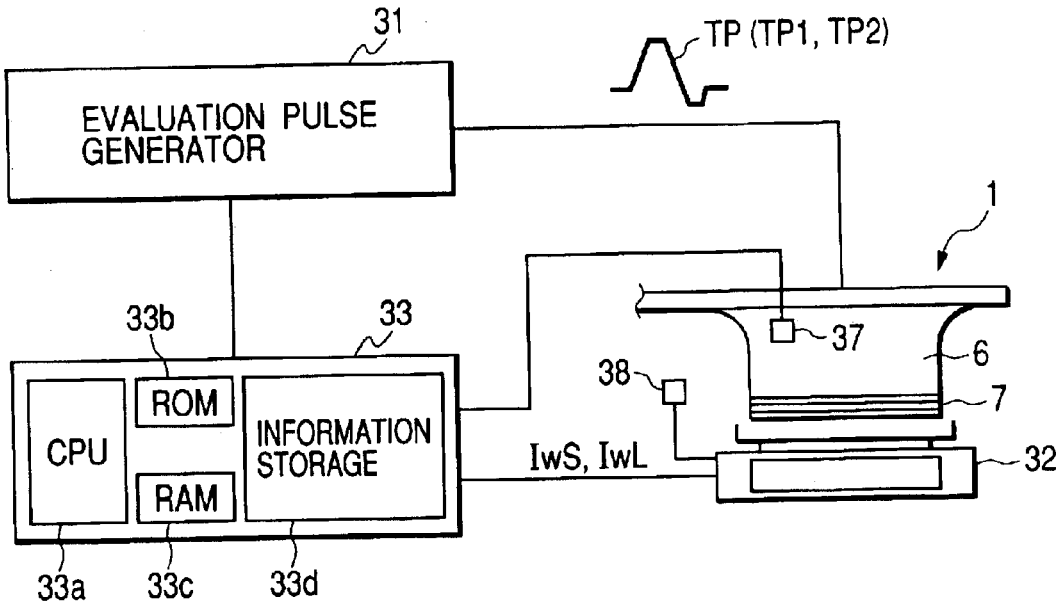
FIG. 3 is a diagram showing a natural vibration period measuring apparatus according to a first embodiment of the invention.

In this case, for example, as shown in FIG. 3, the temperature of the measuring environment is measured by a thermistor 37 (which is a kind of temperature detector) provided in the recording head 1, and the measuring result is supplied to the controller 33. Then, the controller 33 corrects the determined value of the natural vibration period Tc on the basis of the temperature information.

Thus, even in the environment in which the measuring environment cannot help missing the standard temperature (for example, environmental temperature specified by the specification of a measuring apparatus), the natural vibration period Tc can be measured with high accuracy.

The ejected ink amounts may be corrected in accordance with the measured temperature. In this case, for example, a thermistor 38 (which is a kind of temperature detector, see FIG. 3) is electrically connected to the electronic balance 32. The electronic balance 32 corrects the value of measured ink weight on the basis of the measuring result from the thermistor 38. Then, the controller 33 acquires an ink amount ratio on the basis of the corrected ink weight values, and determines the natural vibration period Tc. With this configuration, the natural vibration period Tc can be measured with high accuracy.

Figure 22:
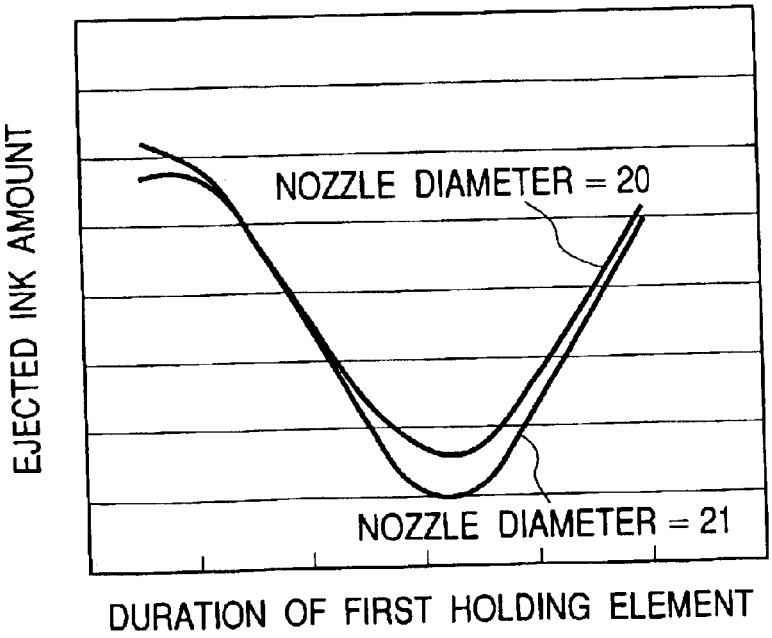
FIG. 22 is a graph showing the relationship between the duration of the first holding element and the ejected ink amount, when the diameter of a nozzle orifice is changed, for explaining a fifth embodiment of the invention.

The correlation between the duration Pwh1 and the ink weight (ink amount) may change depending on dimensions of at least one of the ink supply port 15, the pressure chamber 14 and the nozzle orifice 13. For example, as illustrated in FIG. 22, it has been confirmed that the ejected ink amount in a recording head 1 with a nozzle orifice 13 having a diameter of 20 μm is a little larger than that in a recording head 1 with a nozzle orifice 13 having a diameter of 21 μm. It can be considered that the same thing can be applied to the other factors, that is, the ink supply port 15 and the pressure chamber 14. It is therefore preferable that information of ejected ink amounts can be corrected based on the dimensions. There will be described a fifth embodiment of the invention thus configured.

In this case, for example, an input device (not shown) such as a keyboard or a bar code reader is electrically connected to the controller 33, and dimensional information of the recording head 1 as a subject of measurement is supplied to the controller 33 through the input device. Then, the controller 33 corrects the determined value of the natural vibration period Tc on the basis of the dimensional information.

Alternatively, ejected ink amounts may be corrected on the basis of the dimensional information. In this case, the input device is electrically connected to the electronic balance 32, and the dimensional information of the recording head 1 as a subject of measurement is supplied to the controller through the input device. Then, the electronic balance 32 corrects measured ink weight values (first ink amount IwS and second ink amount IwL) on the basis of the dimensional information. Thus, the natural vibration period Tc of the recording head 1 can be measured with high accuracy.

Figure 25:
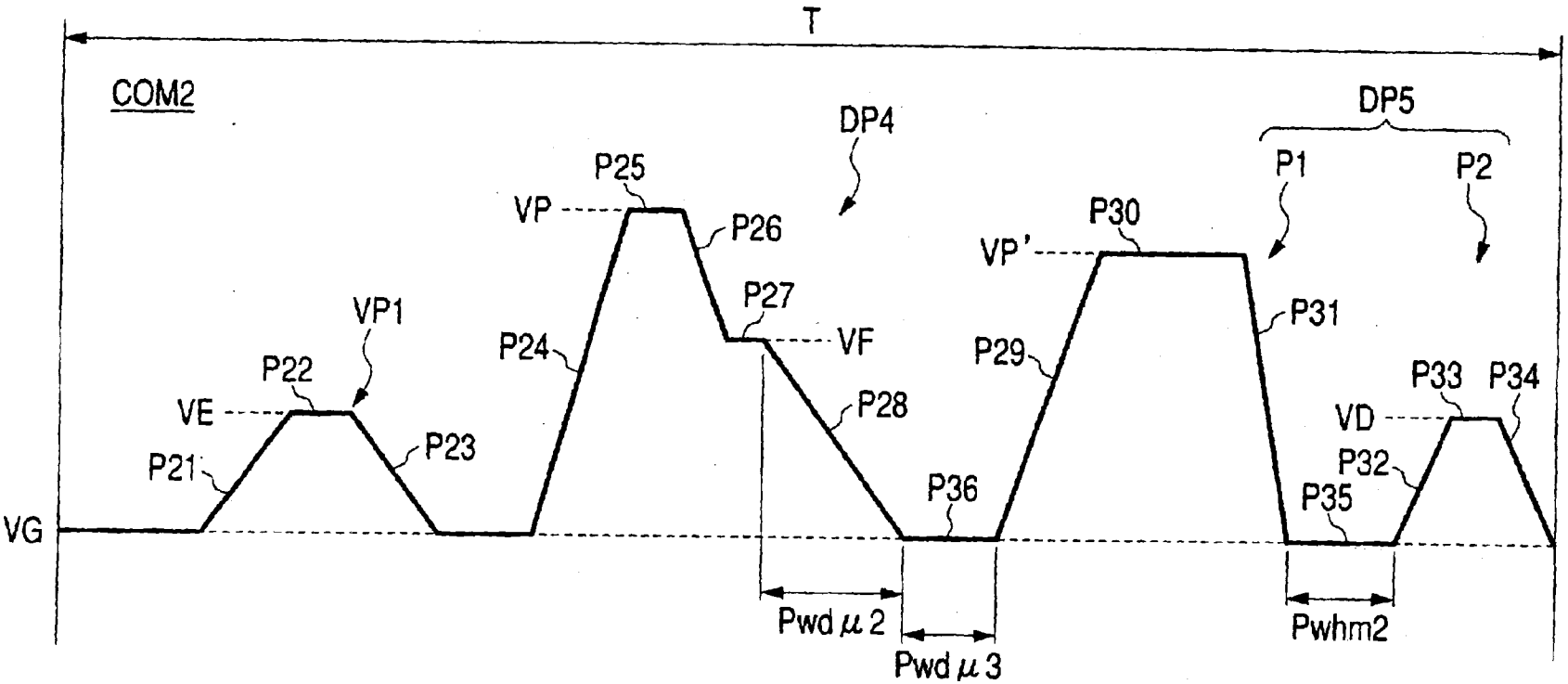
FIG. 25 is a diagram showing a drive signal according to a sixth embodiment of the invention.

Next, description will be made on a sixth embodiment of the invention in which a second drive signal COM2 illustrated in FIG. 25 is adopted. This second drive signal COM2 includes a vibrating pulse VP1 for vibrating the meniscus M, a micro dot driving pulse DP4 generated following the vibrating pulse VP1 and for ejecting an ink droplet with a very small amount capable of forming a micro dot from the nozzle orifice 13, and a middle-dot driving pulse DP5 for ejecting an ink droplet with a small amount capable of forming a middle dot from the nozzle orifice 13. These pulses VP1, DP4 and DP5 are generated repeatedly for every print cycle T.

In this second drive signal COM2, only the vibrating pulse VP1 is chosen and supplied to the piezoelectric vibrator 2 in order not to eject any ink droplet. When dot pattern data is data of a micro dot, only the micro dot driving pulse DP4 is supplied to the piezoelectric vibrator 2. When the dot pattern data is data of a middle dot, only the middle dot driving pulse DP5 is supplied to the piezoelectric vibrator 2. Further, when the dot pattern data is data of a large dot, the micro dot driving pulse DP4 and the middle dot driving pulse DP5 are supplied to the piezoelectric vibrator 2.

The ejected ink amount of each ink droplet in the second drive signal COM2 is smaller than the ejected ink amount of a corresponding ink droplet in the first drive signal COM1. That is, the amount of ink ejected by the supply of the micro dot driving pulse DP4 is smaller than the amount of ink ejected by the supply of the second normal dot driving pulse DP2. In addition, the amount of ink ejected by the supply of the middle dot driving pulse DP5 is smaller than the total amount of ink ejected by the supply of the two normal dot driving pulses DP1 and DP3. Further, the total amount of ink ejected by the supply of the micro dot driving pulse DP4 and the middle dot driving pulse DP5 is smaller than the total amount of ink ejected by the supply of the three normal dot driving pulses DP1 to DP3.

The vibrating pulse VP1 is constituted by a vibrating expansion element P21 for increasing the potential from minimum potential VG to vibrating expansion potential VE in a potential gradient relatively gentle so as not to eject any ink droplet, a vibrating holding element P22 generated following the vibrating expansion element P21 and for keeping the vibrating expansion potential VE for a predetermined time, and a vibrating contraction element P23 generated following the vibrating holding element P22 and for decreasing the potential from the vibrating expansion potential VE to the minimum potential VG in a relatively gentle potential gradient. Then, when the vibrating pulse VP1 is supplied to the piezoelectric vibrator 2, a pressure change slight enough not to eject any ink droplet is generated in the ink in the pressure chamber 14 so that the meniscus M is vibrated finely. In this manner, the ink near the nozzle orifice 13 is prevented from increasing in viscosity.

The micro dot driving pulse DP4 is constituted by a retraction element P24 for increasing the potential from the minimum potential VG to maximum potential VP in a relatively steep gradient, a retraction holding element P25 generated following the retraction element P24 and for keeping the maximum potential VP for a very short time, an ejection element P26 for decreasing the potential from the maximum potential VP to ejection potential VF in a relatively steep gradient, an ejection holding element P27 for keeping the ejection potential VF for a very short time, and a damping element P28 for decreasing the potential from the ejection potential VF to the minimum potential VG in a relatively gentle potential gradient. Then, when the micro dot driving pulse DP4 is supplied to the piezoelectric vibrator 2, a very small amount of an ink droplet is ejected as described above.

The middle dot driving pulse DP5 has an ejection pulse P1 for ejecting an ink droplet and a damping pulse P2 generated following the ejection pulse P1 and for damping the vibration of the meniscus M after the ink droplet ejection.

The ejection pulse P1 is constituted by a filling element P29 for increasing the potential from the minimum potential VG to second maximum potential VP' in a gradient gentle enough not to eject any ink droplet, a filling holding element P30 generated following the filling element P29 and for keeping the second maximum potential VP' for a predetermined time, and an ejection element P31 for decreasing the potential from the second maximum potential VP' to the minimum potential VG in a relatively steep gradient. Incidentally, the second maximum potential VP' is set to be lower than the maximum potential VP and higher than the ejection potential VF.

The damping pulse P2 is constituted by an damping expansion element P32 for increasing the potential from the minimum potential VG to damping potential VD in a potential gradient relatively gentle enough not to eject any ink droplet, a damping holding element P33 generated following the damping expansion element P32 and for keeping the damping potential VD for a predetermined time, and a damping contraction element P34 generated following the damping holding element P33 and for decreasing the potential from the damping potential VD to the minimum potential VG in a relatively gentle potential gradient.

Then, in this middle dot driving pulse DP5, the ejection pulse P1 and the damping pulse P2 are connected through a connecting element P35 having constant potential.

When the middle dot driving pulse DP5 is supplied to the piezoelectric vibrator 2, an ink droplet with a small amount is ejected as described above. Then, in the middle dot driving pulse DP5, an ink droplet is ejected from the nozzle orifice 13 in response to the supply of the ejection pulse P1, and the pressure fluctuation of the ink in the pressure chamber 14 immediately after the ink droplet ejection is absorbed by the supply of the damping pulse P2.

Then, the controller 46 controls the drive signal generator 48 in accordance with the ID information of the recording head 1 so as to establish the control factors of the waveform elements engaging in suppression of the vibration of the meniscus M. In this example, duration Pwd$\mu$2 of the damping element P28 and duration Pwhm2 of the connecting element P35 are changed.

First, description will be made on the duration Pwd$\mu$2 of the damping element P28. The duration Pwd$\mu$2 defines the contraction speed of the pressure chamber 14 caused by the damping element P28. Accordingly, when the duration Pwdμ2 is made shorter than its designed value, the contraction speed of the pressure chamber 14 becomes higher than its designed value. On the contrary, when the duration Pwdμ2 is made longer than its designed value, the contraction speed of the pressure chamber 14 becomes lower than its designed value.

When the natural vibration period Tc indicated by the ID information is equal to the standard natural vibration period Tcstd, the duration Pwdμ2 of the damping element P28 is also set to be equal to its designed value. When the natural vibration period Tc is shorter than the standard natural vibration period Tcstd, the duration Pwdμ2 is set to be shorter than the designed value. On the contrary, when the natural vibration period Tc is longer than the standard natural vibration period Tcstd, the duration Pwdμ2 is set to be longer than the designed value. In such a manner, the damping element P28 can be optimized in accordance with the natural vibration period Tc. Thus, the kinetic energy of the ink after the ink droplet ejection which energy varies in accordance with the natural vibration period Tc can be absorbed efficiently.

Incidentally, the duration Pwdμ2 of the damping element P28 can be changed in the same manner as in the first drive signal COM1 shown in FIG. 24. For example, table information for defining the relationship between the natural vibration period Tc and the duration Pwdμ2 may be prepared so that the duration Pwdμ2 can be established with reference to the table information by the controller 46.

In this case, since the durations of the waveform elements are control factors, the first correction time period and the second correction time period may be added to the reference duration so as to establish the duration Pwdμ2.

In addition, when the duration Pwdμ2 of the damping element P28 is changed from its designed value, the duration Pwdμ3 of the constant potential element P36 for connecting the termination end of the micro dot driving pulse DP4 and the initial end of the middle dot driving pulse DP5 (ejection pulse P1) through the minimum potential VG is also changed. That is, when the duration Pwdμ2 is set to be shorter than its designed value, the duration Pwdμ3 of the constant potential element P36 is set to be longer correspondingly. On the contrary, when the duration Pwdμ2 is set to be longer than its designed value, the duration Pwdμ3 of the constant potential element P36 is set to be shorter correspondingly.

As a result, the interval between the end of the micro dot driving pulse DP4 and the middle dot driving pulse DP5, in particular, the interval between the ejection element P26 and the ejection element P31 can be fixed so that the positions where the flight deviation of ink drops can be prevented.

Next, description will be made on the duration Pwhm2 of the pulse connecting element P35. The duration Pwhm2 defines the supply start timing of the damping expansion element P32 in the middle dot driving pulse DP5. That is, the pulse connecting element P35 has a function similar to that of the damping holding element P14 in the normal dot driving pulses DP1 to DP3.

Accordingly, the duration Pwhm2 is set to be equal to its designed value when the natural vibration period Tc indicated by the ID information is equal to the standard natural vibration period Tcstd. When the natural vibration period Tc is shorter than the standard natural vibration period Tcstd, the duration Pwhm2 is set to be shorter than the designed value. On the contrary, when the natural vibration period Tc is longer than the standard natural vibration period Tcstd, the duration Pwhm2 is set to be longer than the designed value.

As a result, the damping expansion element P32 can be supplied at a timing suitable to the recording head 1 so that the meniscus M can be restored from vibration effectively.

Figure 26A:
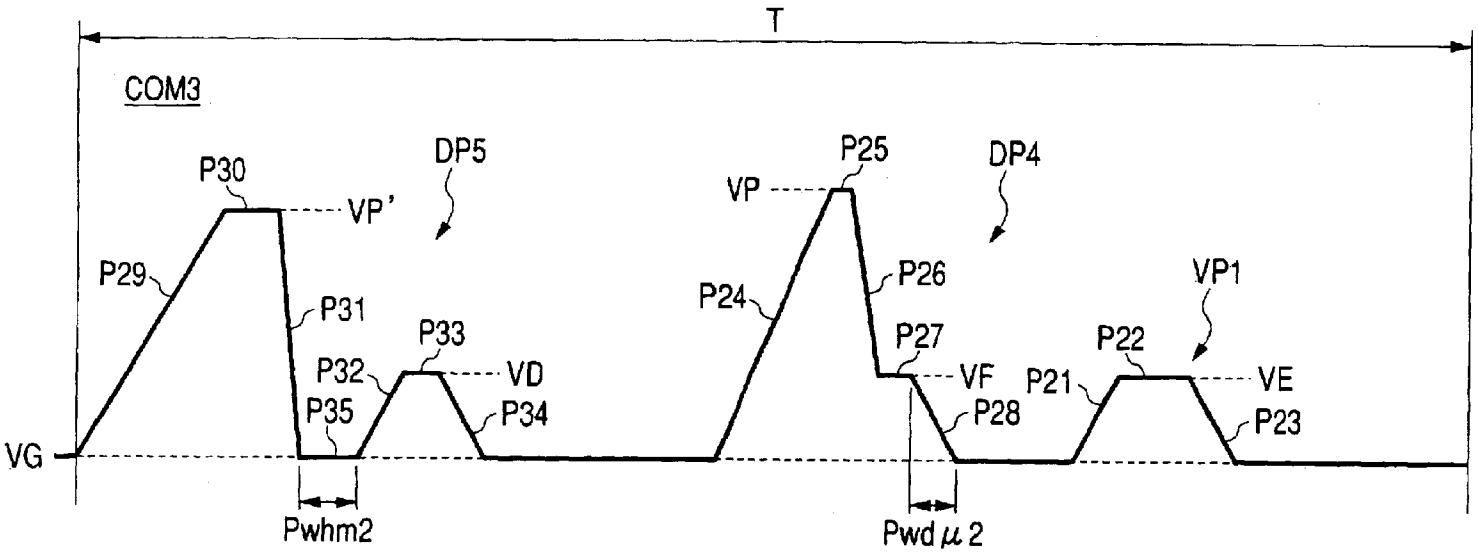
FIGS. 26A and 26B are diagrams showing drive signals according to a seventh embodiment of the invention.
Figure 26B:
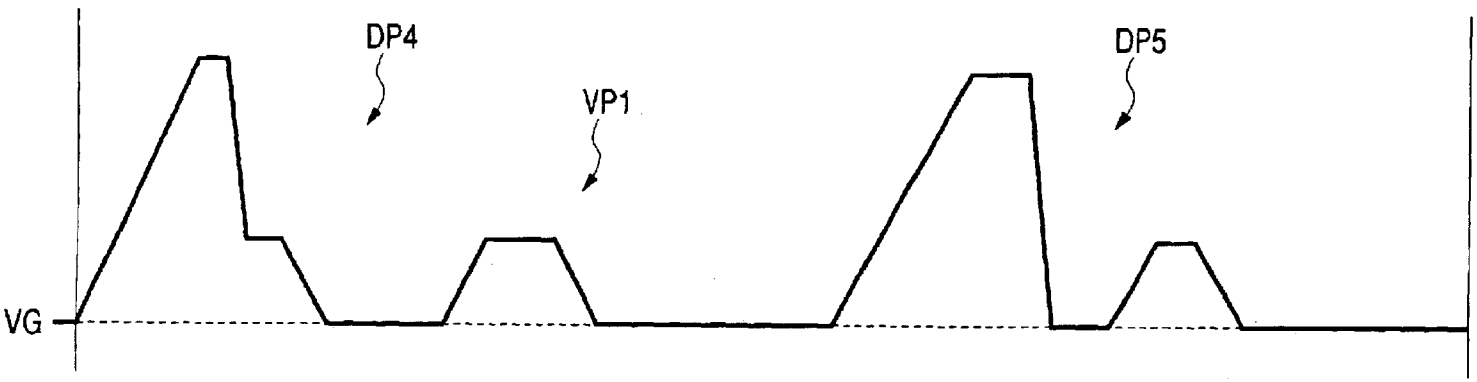

Next, description will be made on a seventh embodiment in which a third drive signal COM3 illustrated in FIGS. 26A and 26B is adopted. This third drive signal COM3 includes a vibrating pulse VP1 (P21–P23), a micro dot driving pulse DP4 (P24–P28) and a middle dot driving pulse DP5 (P29–P35) in the same manner as in the second drive signal COM2. The respective pulses VP1, DP4 and DP5 are generated repeatedly for every print cycle T. These pulses are equal to the pulses of the second drive signal COM2 though there is some difference in potential difference or time width in each waveform element. Therefore, detailed description of the pulses will be omitted.

In the third drive signal COM3, the order with which the driving pulses are generated is changed in accordance with the scanning direction of the recording head 1. That is, when the recording head 1 moves out of the home position, the drive signal generator 48 generates the middle dot driving pulse DP5 at the start of the print cycle T, next generates the micro dot driving pulse DP4, and finally generates the vibrating pulse VP1, as shown in FIG. 26A. On the other hand, when the recording head 1 moves back to the home position, the drive signal generator 48 generates the micro dot driving pulse DP4 at the start of the print cycle, next generates the vibrating pulse VP1, and finally generates the middle dot driving pulse DP5, as shown in FIG. 26B.

Then, the controller 46 controls the drive signal generator 48 in accordance with the ID information of the recording head 1 so as to establish the control factors of the waveform elements engaging in suppression of the vibration of the meniscus M. In this example, duration Pwdμ2 of the damping element P28 and duration Pwhm2 of the pulse connecting element P35 are changed in the same manner as in the second drive signal COM2.

Figure 27:
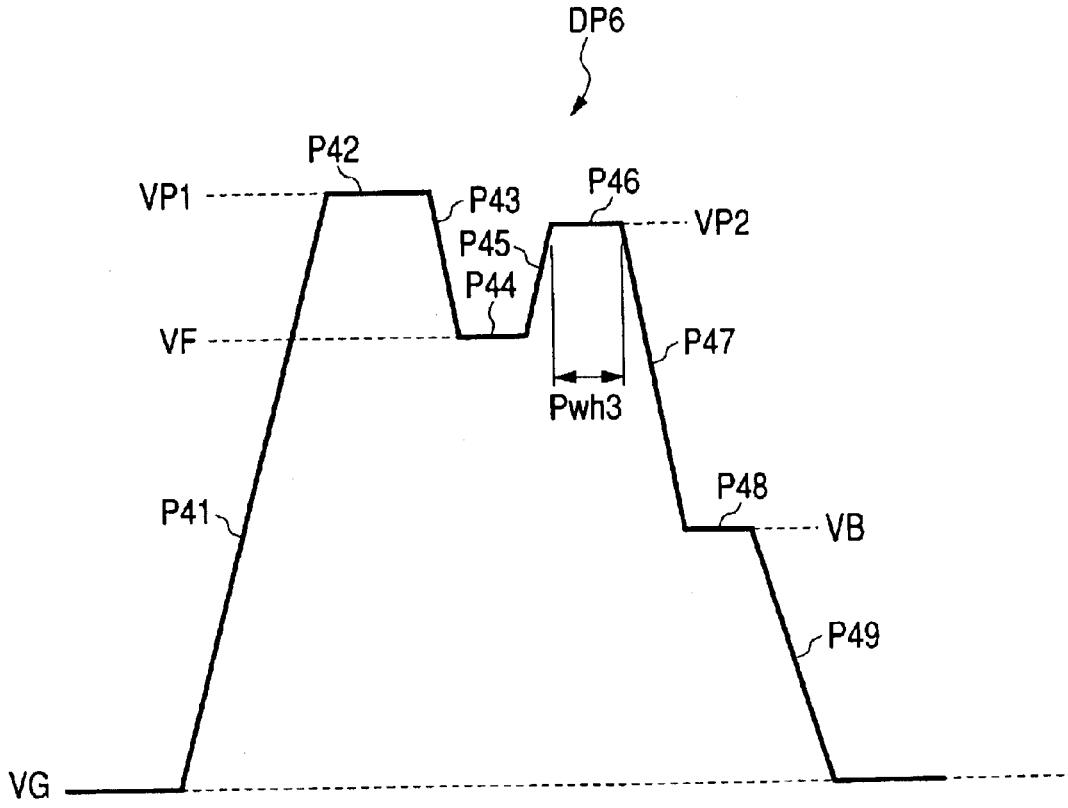
FIG. 27 is a diagram showing a drive signal according to an eighth embodiment of the invention.

The optimization of the driving pulses based on the ID information (determined natural vibration period Tc) is not limited to the driving pulses. That is, various driving pulses can be optimized. For example, optimization based on the ID information can be also carried out on a micro dot driving pulse DP6 shown in FIG. 27. There will be described an eighth embodiment of the invention thus configured.

This micro dot driving pulse DP6 is constituted by a retraction element P41 for increasing the potential from minimum potential VG to first maximum potential VP1 in a gradient gentle enough not to eject any ink droplet and as quickly as possible, a retraction holding element P42 for keeping the first maximum potential VP1 for a very short time period, an ejection element P43 for decreasing the potential from the first maximum potential VP1 to ejection potential VF in a gradient as steep as possible, a first ejection holding element P44 for keeping the ejection potential VF for a very short time, an ejection retraction element P45 for increasing the potential from the ejection potential VF to second maximum potential VP2 in a gradient as steep as possible, a first damping holding element P46 for keeping the second maximum potential for a very short time period, a first damping element P47 for decreasing the potential from the second maximum potential to damping potential VB in a constant gradient, a second damping holding element P48 for keeping the damping potential VB for a predetermined time period, and a second damping element P49 for decreasing the potential from the damping potential VB to the minimum potential VG in a constant gradient.

When the micro dot driving pulse DP6 is supplied to the piezoelectric vibrator 2, an ink droplet with a very small amount corresponding to a micro dot is ejected from the nozzle orifice 13. The amount of an ink droplet ejected by the supply of the micro dot driving pulse DP6 is smaller than the amount of an ink droplet ejected by the supply of the micro dot driving pulse DP4.

Then, the controller 46 controls the drive signal generator 48 in accordance with the ID information of the recording head 1 so as to establish the control factors of the waveform elements engaging in suppression of the vibration of the meniscus M. In this embodiment, duration Pwh3 of the first damping holding element P46 is changed and optimized. As a result of this optimization, the meniscus M can be restored rapidly from vibration immediately after the ink droplet ejection. Thus, when high-frequency driving is performed, amount, flight velocity and the like of an ejected ink droplet can be stabilized.

As described above, in each embodiment, the controller 46 changes a control factor (e.g. duration) of a waveform element (e.g. the damping holding element P14 or the ejection holding element P27) constituting the driving pulse DP1–DP6 on the basis of the ID information. Then, the ID information indicates the natural vibration period Tc of the recording head 1 with high accuracy because the ID information is acquired on the basis of the ink amount ratio (IwS/IwL). Accordingly, even if the natural vibration period Tc of the ink in the pressure chamber 14 has a variation among individual recording heads 1, each recording head 1 can be driven by a drive signal COM whose waveform is suitable to the recording head 1. As a result, the variation of the natural vibration period Tc in the stage of manufacturing can be corrected so that the ink droplet ejecting characteristic in each recording head 1 can be made identical.

The invention is not limited to the embodiments, but various modifications can be made within the scope stated in the claims.

As for the waveform elements to be changed in accordance with the ID information, the embodiments have described on the case where the damping holding element P14, the damping element P28, the pulse connecting element P35 and so on are used, by way of example, as waveform elements engaging in suppression of the vibration of the meniscus M after ink drop ejection. However, the invention may be applicable to the case where other waveform elements are changed. For example, a waveform element having influence on the flying characteristic of an ink droplet, such as the expansion element P11 or the expansion holding element P12 in the normal dot driving pulse DP1–DP3 or the filling holding element P30 in the middle dot driving pulse DP5 may be changed.

The ID information may be replaced by ink amount ratio information indicating the ink amount ratio, which ink amount ratio information is provided for the recording head 1. Then, the controller 46 changes the waveform likewise in a driving pulse on the basis of the ink amount ratio information stored in the memory 36 or the like.

The pressure generating element is not limited to the piezoelectric vibrator 2, but other elements may be used. For example, a heating element may be used. Further, an electromechanical transducing element such as a magnetostrictive element or an electrostatic actuator may be used alternatively.

Although the natural vibration period Tc (ink amount ratio) was measured on the whole of the recording head 1 in the aforementioned embodiments, it may be measured on every nozzle array. In this case, the natural vibration period Tc is provided for every nozzle array so that fine-tuned control can be achieved.

The above description was made on an ink jet printer which is a kind of liquid jetting apparatus, by way of example. The invention is applicable to any other liquid jetting apparatus. For example, the invention is applicable to a display manufacturing apparatus for manufacturing a color filter of a liquid crystal display or the like, an electrode manufacturing apparatus for forming electrodes for an organic EL (electro luminescence) display, an FED (field emission display) or the like, a chip manufacturing apparatus for producing biochips, and a micropipette for supplying a very small amount of a sample solution accurately.

In the display manufacturing apparatus, solutions of respective color materials of R (red), G (green) and B (blue) are ejected from color material jet heads. In the electrode manufacturing apparatus, an electrode material in a liquid form is ejected from an electrode material jet head. In the chip manufacturing apparatus, a solution of bioorganic matter is ejected from a bioorganic matter jet head.

What is claimed is:

1. A method of measuring a natural vibration period of a liquid jetting head provided with a nozzle orifice, a pressure chamber communicated with the nozzle orifice, a liquid supply port which supplies liquid into the pressure chamber, and a pressure generation element which causes pressure fluctuation in the liquid contained in the pressure chamber, the method comprising steps of:

providing a first evaluation signal including a first excitation element adapted to excite pressure fluctuation in liquid contained in the pressure chamber and a first ejection element which follows the excitation element after a first time period to eject a first liquid droplet from the nozzle;

providing a second evaluation signal including a second excitation element adapted to excite pressure fluctuation in liquid contained in the pressure chamber and a second ejection element which follows the excitation element after a second time period to eject a second liquid droplet from the nozzle, which is longer than the first time period;

supplying the first evaluation signal to the pressure generating element to measure a first ejected amount of the first liquid droplet;

supplying the second evaluation signal to the pressure generating element to measure a second ejected amount of the second liquid droplet;

calculating an ejected amount ratio of the first ejected amount and the second ejected amount; and determining the natural vibration period of the liquid jetting head based on the ejected amount ratio.

2. The measuring method as set forth in claim 1, further comprising steps of:

providing a plurality of measurement signals, each including an excitation element adapted to excite pressure fluctuation in liquid contained in the pressure chamber and an ejection element which follows the excitation element after a predetermined time period different from another measurement signals to eject a liquid droplet from the nozzle;

providing a first liquid jetting head having a maximum natural vibration period that can be established in a manufacturing process;

providing a second liquid jetting head having a minimum natural vibration period that can be established in the manufacturing process;

supplying the measurement signals to the first liquid jetting head to obtain a first ejected amount fluctuation curve which indicates relationship between input natural vibration periods and output ejected liquid amounts in the first liquid jetting head;

supplying the measurement signals to the second liquid jetting head to obtain a second ejected amount fluctuation curve which indicates relationship between input natural vibration periods and output ejected liquid amounts in the second liquid jetting head;

determining a first time range in which an output ejected liquid amount increases in accordance with increase of an input natural vibration period in both of the first ejected amount fluctuation curve and the second ejected amount fluctuation curve;

determining a second time range in which an output ejected liquid amount decreases in accordance with increase of an input natural vibration period in both of the first ejected amount fluctuation curve and the second ejected amount fluctuation curve;

determining the first time period such that the first ejection element is supplied at a timing in the first time range; and determining the second time period such that the second ejection element is supplied at a timing in the second time range.

3. The measuring method as set forth in claim 2, wherein:

the first time range continues from one peak point in the first ejected amount fluctuation curve to one bottom point in the second ejected amount fluctuation curve which is adjacent to the one peak point; and the second time range continues from one bottom point in the first ejected amount fluctuation curve to one peak point in the second ejected amount fluctuation curve which is adjacent to the one bottom point.

4. The measuring method as set forth in claim 2, further comprising steps of:

providing a third liquid jetting head having a standard natural vibration period which matches with a designed value;

supplying the measurement signals to the third liquid jetting head to obtain a third ejected amount fluctuation curve which indicates relationship between input natural vibration periods and output ejected liquid amounts in the third liquid jetting head; and determining the first time period and the second time period such that the first ejection element and the second ejection element are supplied at timings at which the third ejected amount fluctuation curve has a maximum gradient value.

5. The measuring method as set forth in claim 2, wherein the first time range and the second time range are determined within adjacent fluctuation cycles of the first ejected amount fluctuation curve and the second ejected amount fluctuation curve.

6. The measuring method as set forth in claim 1, further comprising steps of:

providing a plurality of measurement signals, each including an excitation element adapted to excite pressure fluctuation in liquid contained in the pressure chamber and an ejection element which follows the excitation element after a predetermined time period different from another measurement signals to eject a liquid droplet from the nozzle;

providing a first liquid jetting head having a maximum natural vibration period that can be established in a manufacturing process;

providing a second liquid jetting head having a minimum natural vibration period that can be established in the manufacturing process;

supplying the measurement signals to the first liquid jetting head to obtain a first ejected amount fluctuation curve which indicates relationship between input natural vibration periods and output ejected liquid amounts in the first liquid jetting head;

supplying the measurement signals to the second liquid jetting head to obtain a second ejected amount fluctuation curve which indicates relationship between input natural vibration periods and output ejected liquid amounts in the second liquid jetting head; and determining the first time period and the second time period such that the first ejection element and the second ejection element are supplied at timings within a time range from one peak point in the first ejected amount fluctuation curve to one peak point in the second ejected amount fluctuation curve which is adjacent to the one peak point.

7. The measuring method as set forth in claim 6, further comprising steps of:

providing a third liquid jetting head having a standard natural vibration period which matches with a designed value;

supplying the measurement signals to the third liquid jetting head to obtain a third ejected amount fluctuation curve which indicates relationship between input natural vibration periods and output ejected liquid amounts in the third liquid jetting head; and determining the first time period and the second time period such that an average value thereof is placed on one bottom point in the third ejected amount fluctuation curve.

8. The measuring method as set forth in claim 7, wherein a difference between the first time period and the second time period is a half of the standard natural vibration period.

9. The measuring method as set forth in claim 1, wherein each potential difference of the first excitation element and the second excitation element is not less than 90% of each potential difference of the first ejection element and the second ejection element.

10. The measuring method as set forth in claim 9, wherein each potential difference of the first excitation element and the second excitation element is not less than 95% of each potential difference of the first ejection element and the second ejection element.

11. The measuring method as set forth in claim 1, further comprising steps of:

judging whether the ejected amount ratio is within a predetermined value range;

modifying at least one of the first evaluation signal and the second evaluation signal when the ejected amount ratio is not within the predetermined value range; and measuring at least one of the first ejected amount and the second ejected amount with at least one modified evaluation signal before the step of determining the natural vibration period.

12. The measuring method as set forth in claim 11, wherein both of the first evaluation signal and the second evaluation signal when the ejected amount ratio is not within the predetermined value range.

13. The measuring method as set forth in claim 11, further comprising step of updating the ejected amount ratio based on the first ejected amount and the second ejected amount measured with the at least one modified evaluation signal.

14. The measuring method as set forth in claim 13, wherein:

the first time period is updated to a further shorter third time period when the determined natural vibration period is less than a predetermined value range; and the second time period is updated to a further longer fourth time period when the determined natural vibration period is greater than the predetermined value range.

15. The measuring method as set forth in claim 1, wherein the natural vibration period is determined based on a correlation between the ejected amount ratio and the natural vibration period.

16. The measuring method as set forth in claim 15, wherein the correlation is provided as a linear expression in which the ejected amount ratio serves as a variable.

17. The measuring method as set forth in claim 16, wherein:

a variable range of the ejected amount ratio is divided into a plurality of ranges; and the linear expression is provided with respect to each of the divided ranges.

18. The measuring method as set forth in claim 17, wherein the divided ranges includes a first range which is less than a standard ejected amount ratio corresponding to a designed natural vibration period, and a second range which is not less than the standard ejected amount ratio.

19. The measuring method as set forth in claim 17, wherein the divided ranges includes a first range including a standard ejected amount ratio corresponding to a designed natural vibration period, a second range which is less than the first range, and a third range which is greater than the first range.

20. The measuring method as set forth in claim 1, wherein the first evaluation signal and the second evaluation signal are supplied to the pressure generating element at a frequency which is not greater than 10 kHz.

21. The measuring method as set forth in claim 20, wherein the first evaluation signal and the second evaluation signal are supplied to the pressure generating element at a frequency which is not greater than 5 kHz.

22. The measuring method as set forth in claim 1, further comprising steps of:

measuring temperature of operation environment of the liquid jetting head; and correcting the natural vibration period based on the temperature.

23. The measuring method as set forth in claim 1, further comprising steps of:

acquiring dimension information regarding at least one of the liquid supply port, pressure chamber and the nozzle orifice; and correcting the natural vibration period based on the dimension information.

24. The measuring method as set forth in claim 1, wherein the liquid is ink comprising a coloring material.

25. A liquid jetting recording head, comprising:

a nozzle orifice;

a pressure chamber communicated with the nozzle orifice;

a liquid supply port which supplies liquid into the pressure chamber;

a pressure generation element which causes pressure fluctuation in the liquid contained in the pressure chamber; and an indicator, which indicates the natural vibration period determined by the measuring method as set forth in claim 1.

26. The liquid jetting head as set forth in claim 25, further comprising an information storage, which stores the natural vibration period.

27. The liquid jetting head as set forth in claim 25, wherein the indicator is optically readable member.

28. A liquid jetting recording head, comprising:

a nozzle orifice;

a pressure chamber communicated with the nozzle orifice;

a liquid supply port which supplies liquid into the pressure chamber;

a pressure generation element which causes pressure fluctuation in the liquid contained in the pressure chamber; and an indicator, which indicates the ejected amount ratio calculated by the measuring method as set forth in claim 1.

29. The liquid jetting head as set forth in claim 28, further comprising an information storage, which stores the ejected amount ratio.

30. The liquid jetting head as set forth in claim 28, wherein the indicator is optically readable member.

31. The liquid jetting apparatus as set forth in claim 30, wherein the corrector corrects a reference potential of the drive signal defined as an initial end potential and a termination end potential at a unit driving cycle.

32. A liquid jetting apparatus, comprising:

the liquid jetting head a nozzle orifice, a pressure chamber communicated with the nozzle orifice, a liquid supply port which supplies liquid into the pressure chamber, a pressure generation element which causes pressure fluctuation in the liquid contained in the pressure chamber, and an indicator which indicates ID information regarding the natural vibration period determined by the measuring method as set forth in claim 1;

a drive signal generator, which generate a drive signal for driving the pressure generating element; and a corrector, which corrects a waveform of the drive signal based on the ID information.

33. The liquid jetting apparatus as set forth in claim 32, wherein the ID information is numeric information indicating the natural vibration period.

34. The liquid jetting apparatus as set forth in claim 32, wherein the ID information is information regarding the ejected amount ratio.

35. The liquid jetting apparatus as set forth in claim 32, further comprising an information storage, which stores the ID information, wherein the corrector corrects the waveform of the drive signal based on the ID information stored in the information storage.

36. The liquid jetting apparatus as set forth in claim 32, wherein:

the drive signal includes a plurality of waveform elements including an ejection element adapted to eject a liquid droplet from the nozzle orifice; and the corrector corrects a control factor in at least one of the waveform elements.

37. The liquid jetting apparatus as set forth in claim 36, wherein:

the control factor is a duration of the at least one corrected waveform element; and the duration includes an invariable reference duration and a first duration which is variable in accordance with the ID information.

38. The liquid jetting apparatus as set forth in claim 37, wherein the duration includes a second duration which is variable in accordance with temperature of operation environment of the liquid jetting apparatus.

39. The liquid jetting apparatus as set forth in claim 36, wherein the corrected waveform element is a damping element related to damping operation of pressure fluctuation after liquid ejection.

40. The liquid jetting apparatus as set forth in claim 39, wherein:

the waveform elements includes a damping expansion element which expands the pressure chamber to damp the pressure fluctuation after the liquid ejection, and a damping hold element generated between the ejection element and the damping expansion element and having a constant potential; and the control factor is a duration of the damping hold element.

41. The liquid jetting apparatus as set forth in claim 39, wherein the waveform elements includes a damping contraction element which contracts the pressure chamber to damp the pressure fluctuation after the liquid ejection; and the control factor is a duration of the damping contraction element.

42. The liquid jetting apparatus as set forth in claim 36, wherein the waveform elements includes an expansion element which expands the pressure chamber to pull a meniscus of liquid in the nozzle orifice toward the pressure chamber, and an expansion holding element generated between the expansion element and the ejection element and having a constant potential; and the control factor is a duration of the expansion holding element.

43. An apparatus for measuring a natural vibration period of a liquid jetting head provided with a nozzle orifice, a pressure chamber communicated with the nozzle orifice, a liquid supply port which supplies liquid into the pressure chamber, and a pressure generation element which causes pressure fluctuation in the liquid contained in the pressure chamber, the apparatus comprising:

a first evaluation signal generator, which generates a first evaluation signal including a first excitation element adapted to excite pressure fluctuation in liquid contained in the pressure chamber and a first ejection element which follows the excitation element after a first time period to eject a first liquid droplet from the nozzle;

a second evaluation signal generator, which generates a second evaluation signal including a second excitation element adapted to excite pressure fluctuation in liquid contained in the pressure chamber and a second ejection element which follows the excitation element after a second time period to eject a second liquid droplet from the nozzle;

a first evaluation signal supplier, which supplies the first evaluation signal to the pressure generating element to measure a first ejected amount of the first liquid droplet;

a second evaluation signal supplier, which supplies the second evaluation signal to the pressure generating element to measure a second ejected amount of the second liquid droplet;

a calculator, which calculates an ejected amount ratio of the first ejected amount and the second ejected amount; and a natural vibration period determinant, which determines the natural vibration period of the liquid jetting head based on the ejected amount ratio.

* * * * *

UNITED STATES PATENT AND TRADEMARK OFFICE

CERTIFICATE OF CORRECTION

PATENT NO. : 6,811,241 B2
DATED : November 2, 2004
INVENTOR(S) : Keisuke Nishida et al.

It is certified that error appears in the above-identified patent and that said Letters Patent is hereby corrected as shown below:

Title page,
Item [75], Inventors, should read -- Keisuke Nishida, Nagano (JP); Satoru Hosono, Nagano (JP); Tomoaki Takahashi, Nagano (JP); Ryoichi Tanaka, Nagano (JP); Hirofumi Teramae, Nagano (JP) --

Signed and Sealed this

Third Day of May, 2005

JON W. DUDAS
*Director of the United States Patent and Trademark Office*